US009420861B1

(12) United States Patent
Israel

(10) Patent No.: US 9,420,861 B1
(45) Date of Patent: Aug. 23, 2016

(54) HAIR STRAIGHTENER

(71) Applicant: Eran Israel, Sandy Springs, GA (US)

(72) Inventor: Eran Israel, Sandy Springs, GA (US)

( * ) Notice: Subject to any disclaimer, the term of this patent is extended or adjusted under 35 U.S.C. 154(b) by 0 days.

(21) Appl. No.: 14/493,764

(22) Filed: Sep. 23, 2014

(51) Int. Cl.
*A45D 2/40* (2006.01)
*A45D 2/00* (2006.01)

(52) U.S. Cl.
CPC ..... *A45D 2/001* (2013.01)

(58) Field of Classification Search
CPC ..... A45D 1/00; A45D 1/04; A45D 1/06; A45D 1/08; A45D 1/14; A45D 1/20; A45D 2/001; A45D 2/141; A45D 4/08; A45D 4/12; A45D 2001/045; A45D 2002/025
See application file for complete search history.

(56) References Cited

U.S. PATENT DOCUMENTS 5,861,607 A * 1/1999 Jarrett ..... A45D 1/00 132/224
6,949,216 B2 * 9/2005 Brice ..... B22F 3/008 252/502

* cited by examiner

*Primary Examiner* — Rachel Steitz
(74) *Attorney, Agent, or Firm* — Hartman & Citrin LLC

(57) ABSTRACT

Embodiments of a hair straightener are disclosed herein. According to various embodiments, the hair straightener can include a top portion, which can include a top heating plate and a first hollow end. The top heating plate can include a first heating element and the first hollow end can include a first aperture formed in the top portion. The first aperture can receive a finger of a user. The hair straightener also can include a bottom portion that can include a bottom heating plate and a second hollow end. The bottom heating plate can include a second heating element and a second hollow end that can include a second aperture formed in the bottom portion. The second aperture can receive a thumb of the user. The hair straightener also can include a hinge structure that can join the top portion to the bottom portion.

19 Claims, 17 Drawing Sheets

HAIR STRAIGHTENER

TECHNICAL FIELD

This disclosure relates generally to consumer products. More particularly, the disclosure made herein relates to a hair straightener, a hair designer, a hair styler, or hair curler.

BACKGROUND

Unless otherwise indicated herein, the details in this section are not prior art to the claims in this application and are not admitted to be prior art by inclusion in this section.

Hair straighteners are sometimes used to straighten hair, lengthen the perceived length of hair, reduce volume of hair, and/or for other purposes. Hair straighteners have been used for scores of years for these and other purposes. The first known hair straightener was used in 1872 by Marcel Grateau, who used heated rods to style hair. The general idea of hair styling evolved over the next thirty to forty years.

In 1909, the first dual iron version of the hair straightener was patented by Isaac K. Shero. The dual iron hair straightener relies upon two heated irons, which are put together with the hair located between the irons. The heat from the heated irons can be used to tease or straighten the hair. Since the invention of the dual iron straightener, however, there have not been extensive changes to the general function and/or structure of the hair straightener.

SUMMARY

Concepts and technologies are disclosed herein for a hair straightener, a hair designer, a hair styler, or hair curler that can be held by two or more fingers of a user. In the claims, a "hair straightener" excludes a hair designer, a hair styler, or a hair curler, while the term "hair device" includes a hair straightener, a hair designer, a hair styler, and/or a hair curler. In some embodiments, a user grips the hair straightener by inserting one or more fingers into a top portion of the hair straightener and by inserting a thumb into a bottom portion of the hair straightener. The user can pinch his or her fingers together and/or spread his or her fingers apart to create a gap between two heating plates, one of which can be located on each of the top portion and the bottom portion.

In some embodiments, a spring mechanism can be located between the top portion and the bottom portion. The spring mechanism can urge the top portion away from the bottom portion, thereby creating a gap between the heating plates. A user may apply a pressure to the top portion and the bottom portion by way of pinching his or her fingers to urge the heating plates into contact with hair and/or each other.

In some other embodiments, the spring mechanism can draw the top portion toward the bottom portion, thereby closing a gap formed between the heating plates. A user may apply a pressure to the top portion and the bottom portion by way of opening a pinch of his or her fingers, thereby creating a gap between the heating plates. Pressure can be released to allow the heating plates to come into contact with each other and/or the hair. These and other aspects of the concepts and technologies described herein for a hair straightener will be illustrated and described in more detail herein.

According to one aspect of the concepts and technologies described herein, a hair straightener is disclosed. The hair straightener can include a top portion that can include a top heating plate and a first hollow end. The top heating plate can include a first heating plate and the first hollow end can include a first aperture formed in the top portion. The first aperture can receive a finger of a user. The hair straightener also can include a bottom portion that can include a bottom heating plate and a second hollow end. The bottom heating plate can include a second heating plate and a second hollow end that can include a second aperture formed in the bottom portion. The second aperture can receive a thumb of the user. The hair straightener also can include a hinge structure that can join the top portion to the bottom portion.

In some embodiments, the hair straightener further can include a spring mechanism. The spring mechanism can be located between the top portion and the bottom portion. The top portion, the bottom portion, and the spring mechanism can be formed from a single piece of material. In some embodiments, the top portion can include a rigid plastic inner.

In some embodiments, the top portion can include a soft silicone outer. The top portion can include a stitched neoprene outer. In some embodiments, the hair straightener further can include a padded liner located within the top portion. In some embodiments, the top heating plate can include a sleeve and a heating element. In some embodiments, the heating element can include a substrate, a conductive coil, and electrical connectors.

In some embodiments, the conductive coil can be electrically connected to a power source. The power source can include a battery located within the hair straightener. The power source also can include an external power source. The conductive coil can be electrically connected to the power source by way of a power cord. In some embodiments, the hair straightener further can include a spring mechanism. The spring mechanism can be configured to apply a spring force to the top portion and the bottom portion to urge the top portion away from the bottom portion. In some embodiments, the spring mechanism can be configured to apply a spring force to the top portion and the bottom portion to urge the top portion toward the bottom portion.

According to another aspect of the concepts and technologies described herein, a hair straightener is disclosed. The hair straightener can include a top portion that can include a top heating plate and a first hollow end. The top heating plate can include a first heating plate and the first hollow end can include a first opening formed in the top portion. The first opening can receive a finger of a user. The hair straightener also can include a bottom portion that can include a bottom heating plate and a second hollow end. The bottom heating plate can include a second heating plate and the second hollow end can include a second opening formed in the bottom portion. The second opening can receive a thumb of the user. The hair straightener also can include a hinge structure that can join the top portion to the bottom portion. The hinge can include a spring mechanism.

In some embodiments, the hair straightener further can include a spring mechanism located between the top portion and the bottom portion. In some embodiments, the top heating plate can include a sleeve and a heating element. The heating plate can include a substrate, a conductive coil, and electrical connectors. The conductive coil can be electrically connected to a power source.

According to yet another aspect of the concepts and technologies described herein, a hair straightener is disclosed. The hair straightener can include a top portion that can include a top heating plate, a first hollow end, a first inner, and a first outer. The top heating plate can include a first heating element and the first hollow end can include a first opening formed in the top portion. The first opening can receive a finger of a user. The hair straightener also can include a bottom portion that can include a bottom heating plate, a second hollow end, a second inner, and a second outer. The bottom heating plate can include a second heating element and a second hollow end can include a second opening formed in the bottom portion. The second opening can receive a thumb of the user. The hair straightener also can include a hinge structure that can join the top portion to the bottom portion. The hinge structure can include a spring mechanism. In some embodiments, the first inner and the second inner can be formed from silicone, and the first outer and the second outer can be formed from a soft material.

The foregoing summary is illustrative only and is not in any way limiting. In addition to the illustrative aspects, embodiments, and features described above, further aspects, embodiments, and features will become apparent by reference to the drawings and the following detailed description.

DETAILED DESCRIPTION

Figure 1:
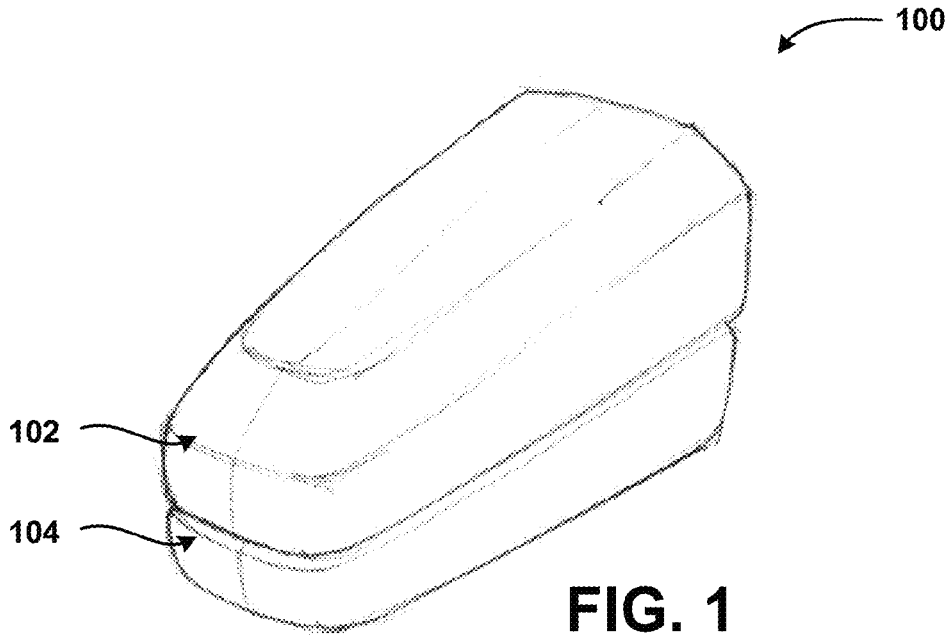
FIG. 1 is line drawing showing a perspective view of a hair straightener, according to an illustrative embodiment of the concepts and technologies described herein.

The following detailed description is directed to a hair straightener. In some embodiments a hair straightener can be formed from a plastic or other material. The hair straightener can include a top portion and a bottom portion. The top portion can be joined to the bottom portion by a hinge or other assembly mechanism. In some other embodiments, the top portion and the bottom portion can be formed from one or more pieces of material, and a spring mechanism can be formed between the top portion and the bottom portion. In some embodiments, a user grips the hair straightener by inserting one or more fingers into a top portion of the hair straightener and by inserting a thumb into a bottom portion of the hair straightener. The user can pinch his or her fingers together and/or spread his or her fingers apart to create a gap between two heating plates, one of which can be located on each of the top portion and the bottom portion.

In some embodiments, a spring mechanism can be located between the top portion and the bottom portion. The spring mechanism can urge the top portion away from the bottom portion, thereby creating a gap between the heating plates. A user may apply a pressure to the top portion and the bottom portion by way of pinching his or her fingers to urge the heating plates into contact with hair and/or each other.

In some other embodiments, the spring mechanism can draw the top portion toward the bottom portion, thereby closing a gap formed between the heating plates. A user may apply a pressure to the top portion and the bottom portion by way of opening a pinch of his or her fingers, thereby creating a gap between the heating plates. Pressure can be released to allow the heating plates to come into contact with each other and/or the hair. These and other aspects of the concepts and technologies described herein for a hair straightener will be illustrated and described in more detail herein.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of hair straighteners will be presented.

Referring first to FIG. 1, aspects of a hair straightener 100 according to various embodiments of the concepts and technologies described herein will be described in detail. In particular, FIG. 1 illustrates one illustrative embodiment of a hair straightener 100. It should be understood that the illustrated and described illustrative embodiment of the hair straightener 100 shown in FIG. 1 is one illustrative embodiment of the concepts and technologies described herein, and therefore should not be construed as being limiting in any way of the concepts and technologies described herein.

In some embodiments, as shown in FIG. 1, a hair straightener 100 can include a hair straightener finger engagement portion ("top portion") 102 and a hair straightener thumb engagement portion ("bottom portion") 104. It should be understood that in some embodiments, the top portion 102 and the bottom portion 104 can be interchanged and/or reversed by users, resulting in the thumb engaging the top portion 102 and/or one or more fingers engaging the bottom portion 104. As such, it should be understood that the use of the terms "top" and "bottom" are used for convenience of description, and not to limit in any way the scope of the disclosure and/or the appended claims.

The top portion 102 can be formed with a hollow end (not visible in FIG. 1) through which one or more fingers of a user can be inserted. According to some embodiments of the hair straightener 100, the hollow end formed in the top portion 102 can accept one finger of the user. According to some other embodiments of the hair straightener 100, a hollow end formed in the top portion 102 can accept two fingers of the user. According to yet other embodiments of the hair straightener 100, the hollow end can accept three fingers of the user. According to still other embodiments of the hair straightener 100, a hollow end formed in the top portion 102 can accept four fingers of the user. For purposes of illustrating and describing the embodiments of the hair straightener 100 herein, the FIGURES illustrate embodiments in which a hollow end formed in the top portion 102 is configured to accept two or three fingers. In light of the various modifications and/or embodiments mentioned above, it should be understood that the illustrated examples are illustrative and therefore should not be construed as being limiting in any way.

According to some embodiments of the hair straightener 100, the top portion 102 can be formed as a single piece of material and can include one of various configurations. In some other embodiments of the hair straightener 100, the top portion 102 can be formed by two or more components or portions that can be joined together in various manners. For example, two or more components or portions can be welded together, stitched or sewn together, connected using an adhesive, connected using a thermoforming process such as melting, joined using mechanical fasteners, combinations thereof, or the like.

In some embodiments of the hair straightener 100, the top portion 102 and/or the bottom portion 104 can include a rigid or semi-rigid structure such as acrylic, hard plastics, metal, resins, or the like. In some other embodiments of the hair straightener 100, the top portion 102 and/or the bottom portion 104 can include a soft structure such as soft plastics, rubber, synthetic rubbers, cloth, combinations thereof, or the like. Various embodiments of the hair straightener 100 will be illustrated and described hereinbelow.

The hair straightener 100 can include a cord, in some embodiments, which can connect the hair straightener 100 to an external power source. In some contemplated embodiments, the hair straightener 100 can include an electrical cord, which can be used to electrically connect one or more heating plates (not visible in FIG. 1) of the hair straightener 100 to an external power source (not visible in FIG. 1) such as an outlet, a universal serial bus ("USB") port, a power adaptor, battery power, or the like. According to some other embodiments, the hair straightener 100 can include an internal power source, which may be disposable, rechargeable, and/or renewable, according to various implementations. Because connecting electrical devices to power sources generally is understood, the various possible configurations of electrical cords or the like are not described further herein for the sake of brevity.

The bottom portion 104 also can be formed with a hollow end (not visible in FIG. 1) through which a thumb of a user can be inserted. According to some embodiments of the hair straightener 100, the hollow end formed in the bottom portion 104 can accept one or more fingers of the user instead of, or in addition to, receiving the thumb of the user. For purposes of illustrating and describing the concepts and technologies described herein, the illustrated embodiments of the bottom portion 104 are shown as including a hollow end that is configured to receive a thumb of a user. In light of the various modifications and/or embodiments mentioned herein, it should be understood that the illustrated examples are illustrative and therefore should not be construed as being limiting in any way.

According to various embodiments of the hair straightener 100, a user of the hair straightener 100 can hold the hair straightener 100 using one or more fingers inserted into the hollow end of the top portion 102 and a thumb inserted into a hollow end of the bottom portion 104. It should not be construed as being limiting in any way that because of the various configurations of the top portion 102 and/or the bottom portion 104 illustrated and described herein, the hollow end may be omitted in some embodiments. In particular, one or more of the top portion 102 and the bottom portion 104 can include one or more fingertip inserts or sleeves for the fingers and/or thumb. Using the inserts or sleeves, a user may hold the hair straightener 100 without the fingers and/or thumb being enclosed or inserted into hollow ends.

Thus, it can be appreciated that straps or other mechanisms also can be used to hold the hair straightener 100 to the fingers and/or thumb. Although these embodiments are contemplated, the appended claims include only embodiments in which the fingers and/or thumb are inserted into hollow ends formed in the top portion 102 and/or the bottom portion 104 unless the claims recite a "top portion without a hollow end" or a "bottom portion without a hollow end." Thus, the top portion 102 and the bottom portion 104 as used herein and/or recited in the claims, are directed to embodiments in which during use at least a majority of the fingers and/or thumb used to hold the hair straightener 100 are located within the hollow ends during use.

As mentioned briefly above, components of the hair straightener 100 can be formed from various materials. According to various embodiments, the top portion 102 of the hair straightener 100, the bottom portion 104 of the hair straightener 100, and/or components of the top portion 102 and/or bottom portion 104 can be formed from one or more plastics, one or more thermoplastics, one or more acrylics, one or more resins, one or more polymers or copolymers, other (non-plastic and non-polymer) materials, and/or combinations thereof. According to some embodiments, the top portion 102, the bottom portion 104, and/or other components of the hair straightener 100 illustrated and described herein can be formed using various manufacturing processes such as injection molding processes, three dimensional printing processes, machining processes, forging processes, combinations thereof, or the like. Because other materials and/or processes can be used to form the top portion 102, the bottom portion 104, and/or other components of the hair straightener 100, it should be understood that these examples are illustrative and therefore should not be construed as being limiting in any way.

The hair straightener 100 shown in FIG. 1 has been described as including one top portion 102 and one bottom portion 104. It should be understood, however, that some embodiments of the hair straightener 100 can include zero, one, or more than one top portion 102 and zero, one, or more than bottom portion 104. Thus, some embodiments of the hair straightener 100 can include two top portions 102, two bottom portions 104, and/or other structures instead of, or in addition to, the top portion 102 and/or the bottom portion 104. It therefore should be understood that the example embodiment shown in FIG. 1 is illustrative of the concepts and technologies described herein and therefore should not be construed as being limiting in any way.

Figure 2:
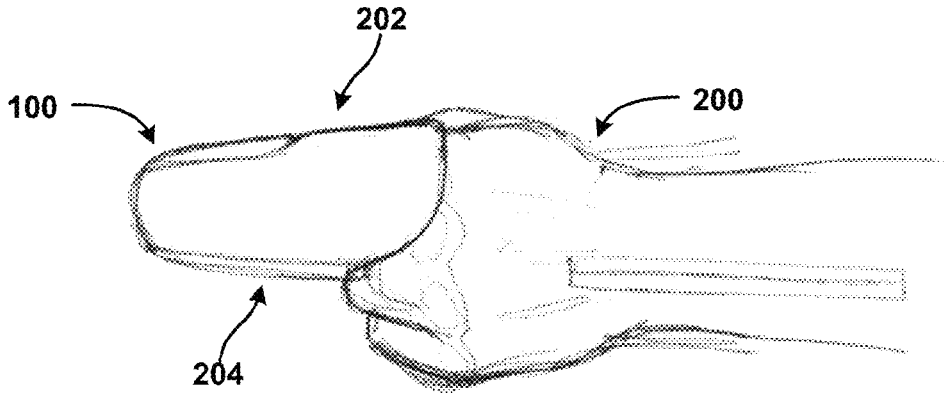
FIG. 2 is a line drawing showing an illustrative operating environment for an example hair straightener, according to an illustrative embodiment of the concepts and technologies described herein.

Turning to FIG. 2, one example operating environment of the hair straightener 100 is shown. As can be seen in FIG. 2, various embodiments of the hair straightener 100 can be held by a single hand 200 of a user. Thus, the hair straightener 100 may be operated (e.g., opened and/or closed) by a user by opening and/or pinching fingers of his or her hand 200. According to various embodiments, the configuration of the hair straightener 100, the ability of a user to wield the hair straightener 100 in one hand 200, and the ability of a user to open and close the hair straightener 100 by way of a natural pinching movement or of the like, can result in ease of use of the hair straightener 100, prevention of hand and/or arm fatigue of the user, and an ability to use the hair straightener 100 in a natural manner. It should be understood that this example is illustrative and therefore should not be construed as being limiting in any way.

In some embodiments of the hair straightener 100, a scalp side 202 of the hair straightener 100 can be formed with a configuration that may differ from a configuration of a knuckle side 204 of the hair straightener 100. Thus, some embodiments of the hair straightener 100 can include various mechanisms for joining the top portion 102 to the bottom portion 104, wherein the various mechanisms may be located on the knuckle side 204 of the hair straightener 100 so that the scalp side 202 can be brought into close proximity with the scalp and/or hair. In other words, if the mechanisms that join the top portion 102 to the bottom portion 104 are bulky, these mechanisms can be located at the knuckle side 204, in some embodiments, to allow easier access to the scalp and/or hair of a user. It should be understood that this example is illustrative and therefore should not be construed as being limiting in any way.

Figure 3A:
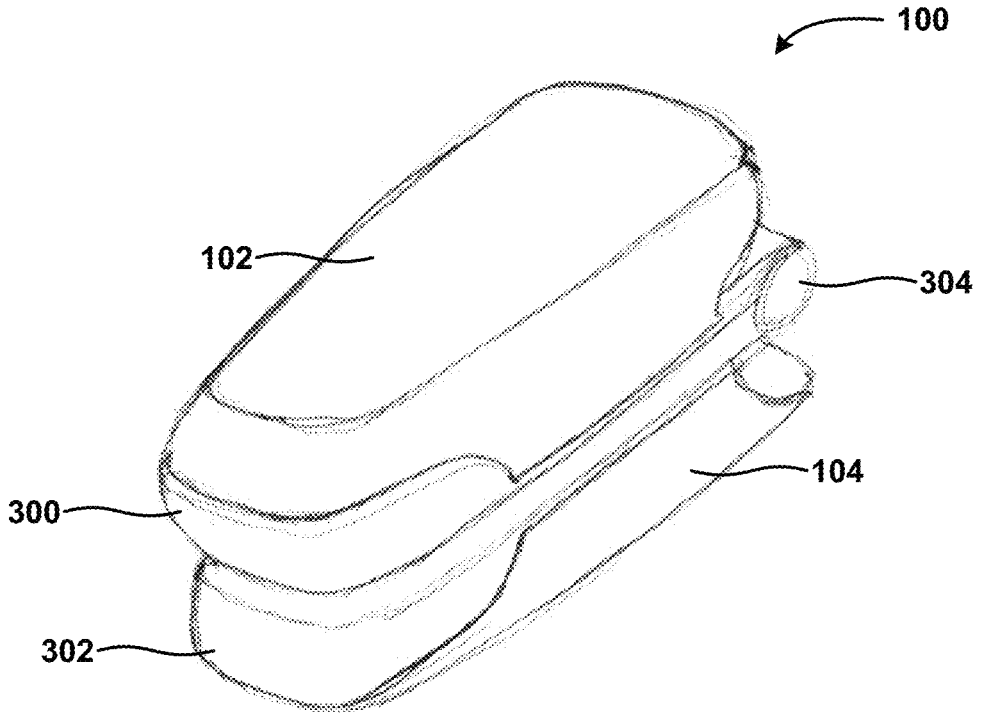
FIG. 3A is a line drawing showing a perspective view of an example hair straightener, according to another illustrative embodiment of the concepts and technologies described herein.
Figure 3B:
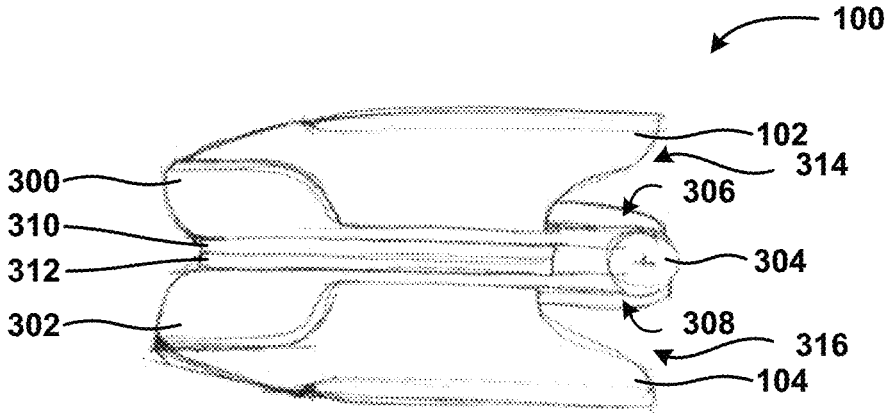
FIG. 3B is a line drawing showing a side elevation view of the hair straightener shown in FIG. 3A, according to an illustrative embodiment of the concepts and technologies described herein.

Turning now to FIGS. 3A-3B, additional aspects of the concepts and technologies described herein for a hair straightener will be described in detail. In particular, FIG. 3A is a perspective view of a hair straightener 100, according to another illustrative embodiment. As shown in FIG. 3A, the hair straightener 100 can include various decorative structures, surfaces, coatings, or the like. In FIG. 3A, the top portion 102 of the hair straightener 100 can include a top portion decorative molding ("top decorative molding") 300, and the bottom portion 104 of the hair straightener 100 can include a bottom portion decorative molding ("bottom decorative molding") 302. One or more of the top decorative molding 300 and the bottom decorative molding 302 can be included merely for decoration, in some embodiments.

In some other embodiments, one or more of the top decorative molding 300 and the bottom decorative molding 302 can be included to provide functionality to the hair straightener 100. For example, in some embodiments one or more of the top decorative molding 300 and the bottom decorative molding 302 can be included to reinforce ends of the top portion 102 and/or the bottom portion 104. For example, one or more of the top portion 102 and the bottom portion 104 may be formed from a soft fabric, silicone, or other material that may be reinforced by a hard plastic, metal, or other material used to form one or more of the top decorative molding 300 and the bottom decorative molding 302. In some other embodiments, the one or more of the top decorative molding 300 and the bottom decorative molding 302 can be included to provide a polished and/or smooth surface to reduce or eliminate snagging of a user's hair while using the hair straightener 100.

In still other embodiments, one or more of the top decorative molding 300 and the bottom decorative molding 302 can be included to protect a seam or stitching that may be included on the top portion 102 and/or the bottom portion 104 to enhance the durability of the hair straightener 100. Because one or more of the top decorative molding 300 and the bottom decorative molding 302 can be included for additional or alternative reasons, and because one or more of the top decorative molding 300 and the bottom decorative molding 302 can be omitted in some embodiments, it should be understood that these examples are illustrative and therefore should not be construed as being limiting in any way.

As shown in FIG. 3A, the hair straightener 100 also can include a hinge 304. The hinge 304 can be included in the hair straightener 100 to provide an axis of rotation about which the top portion 102 and/or the bottom portion 104 rotate. It can be appreciated with reference to FIG. 3A, that a hand 200 or a portion thereof of a user may engage an outside surface of the hinge 304, in some embodiments. In some other embodiments, the hinge 304 can be covered by other surfaces, structures, paddings, or the like, and/or the hinge 304 may be configured such that a hand 200 or a portion thereof of a user may not engage the hinge 304. Additional details of the hinge 304 are illustrated and described below.

Referring now to FIG. 3B, additional aspects of the concepts and technologies described herein for a hair straightener 100 are illustrated and described in detail. In particular, FIG. 3B is a side elevation view of the hair straightener 100 shown in FIG. 3A, according to one example embodiment of the concepts and technologies described herein. As can be seen in FIG. 3B, a top lining 306 can extend over the hinge 304 and/or a portion thereof. Thus, as mentioned above with reference to FIG. 3A, a hand 200 of a user may engage the top lining 306 instead of, or in addition to, engaging an outer surface of the hinge 304. It should be understood that this example is illustrative and therefore should not be construed as being limiting in any way.

The top lining 306 can include various materials and/or combinations of materials. In some embodiments of the concepts and technologies described herein, the top lining 306 can be provided by a foam or other insert as a substrate (not visible in FIG. 3B), which can be covered by a fabric, rubber, cloth, or other material. Thus, the top lining 306 can be a padded insert that can provide a soft surface to engage fingers or a thumb of a hand 200 of a user. It should be understood that this example is illustrative and therefore should not be construed as being limiting in any way.

Similarly, a bottom lining 308 can extend over the hinge 304 and/or a portion thereof. Thus, the hand 200 of a user may engage the bottom lining 308 instead of, or in addition to, engaging an outer surface of the hinge 304. According to various embodiments, the bottom lining 308 can be formed in a manner similar or even identical to a manner used to form the top lining 306. Furthermore, the bottom lining also can include various materials and/or combinations thereof. Thus, the bottom lining 308 can be a padded insert that can provide a soft surface to engage fingers or a thumb of a hand 200 of a user.

It therefore can be appreciated that in some embodiments, the hand 200 of a user may engage the top lining 306 and the bottom lining 308 instead of the hinge 304. In some other embodiments, the hand 200 of the user may engage the top lining 306, the bottom lining 308, and the hinge 304 and/or a portion thereof. It should be understood that these examples are illustrative and therefore should not be construed as being limiting in any way.

As is visible in FIG. 3B, the hair straightener 100 also can include a top portion heating plate ("top heating plate") 310 and a bottom portion heating plate ("bottom heating plate") 312. In some embodiments, one or more of the top heating plate 310 and the bottom heating plate 312 can be formed as an assembly of two or more components, as will be illustrated and described herein with reference to FIGS. 5-6. In some other embodiments, one or more of the top heating plate 310 and the bottom heating plate 312 can be provided by a unitary structure (e.g., a heated plate). Because one or more of the top heating plate 310 and the bottom heating plate 312 can be provided by various structures including, but not limited to, those illustrated and described herein, it should be understood that the illustrated embodiments are illustrative and should not be construed as being limiting in any way.

The top heating plate 310 and the bottom heating plate 312 can be attached to the top portion 102 and the bottom portion 104, respectively. The top heating plate 310 and the bottom heating plate 312 can be configured such that the hair of user can be located or disposed between the top heating plate 310 and the bottom heating plate 312 to straighten the hair of a user. Thus, it can be appreciated that in the embodiment shown in FIGS. 3A-3B, the top heating plate 310 and the bottom heating plate 312 can be rotated about an axis of the hinge 304, and therefore can be rotated into and out of a hair-engagement configuration by pinching or opening a grip of a user.

As is shown in FIG. 3B, the top portion 102 also can include a top portion hollow end ("top hollow end") 314 into which one or more fingers of a hand 200 of a user can be inserted. Similarly, the bottom portion 104 can include a bottom portion hollow end ("bottom hollow end") 316 into which a thumb or finger of a hand 200 of a user can be inserted. Additional features of some embodiments of the top hollow end 314 and the bottom hollow end 316 are illustrated and described herein, particularly with reference to FIGS. 15-24.

In practice, a user may grip the hair straightener 100 in his or her hand 200. The user may open his or grip, thereby moving the top portion 102 away from the bottom portion 104. As a result of this movement, the top heating plate 310 and the bottom heating plate 312 also can be moved away from one another, thereby creating a gap between the top heating plate 310 and the bottom heating plate 312.

The user can locate his or her hair into the gap formed by opening his or her hand 200. When a desired portion of the hair is located within the gap, the user can pinch or otherwise close his or her hand, thereby moving the top portion 102 toward the bottom portion 104 until the top heating plate 310 and the bottom heating plate 312 contact the hair and/or each other. The hair straightener 100 can be held in this orientation for a particular period of time during which the hair can be straightened, flattened, or the like. In some embodiments, one or more of the top heating plate 310 and the bottom heating plate 312 can be configured with surface structures such as ridges, or the like, to allow a user to apply waves or the like to his or her hair. Similarly, one or more of the top heating plate 310 and the bottom heating plate 312 can have a curved surface to allow a user to apply curls to his or her hair. Thus, the various embodiments of the hair straightener 100 illustrated and described herein should be understood as being applicable to other hair devices such as hair curlers, hair designers, hair stylers, combinations thereof, or the like.

Thus, embodiments of the concepts and technologies described herein can be used to provide an easy to use and ergonomic hair straightener 100 that may be used by a user using natural hand movements (pinching the fingers, opening the fingers, or the like). It should be understood that this example is illustrative and therefore should not be construed as being limiting in any way.

Figure 4:
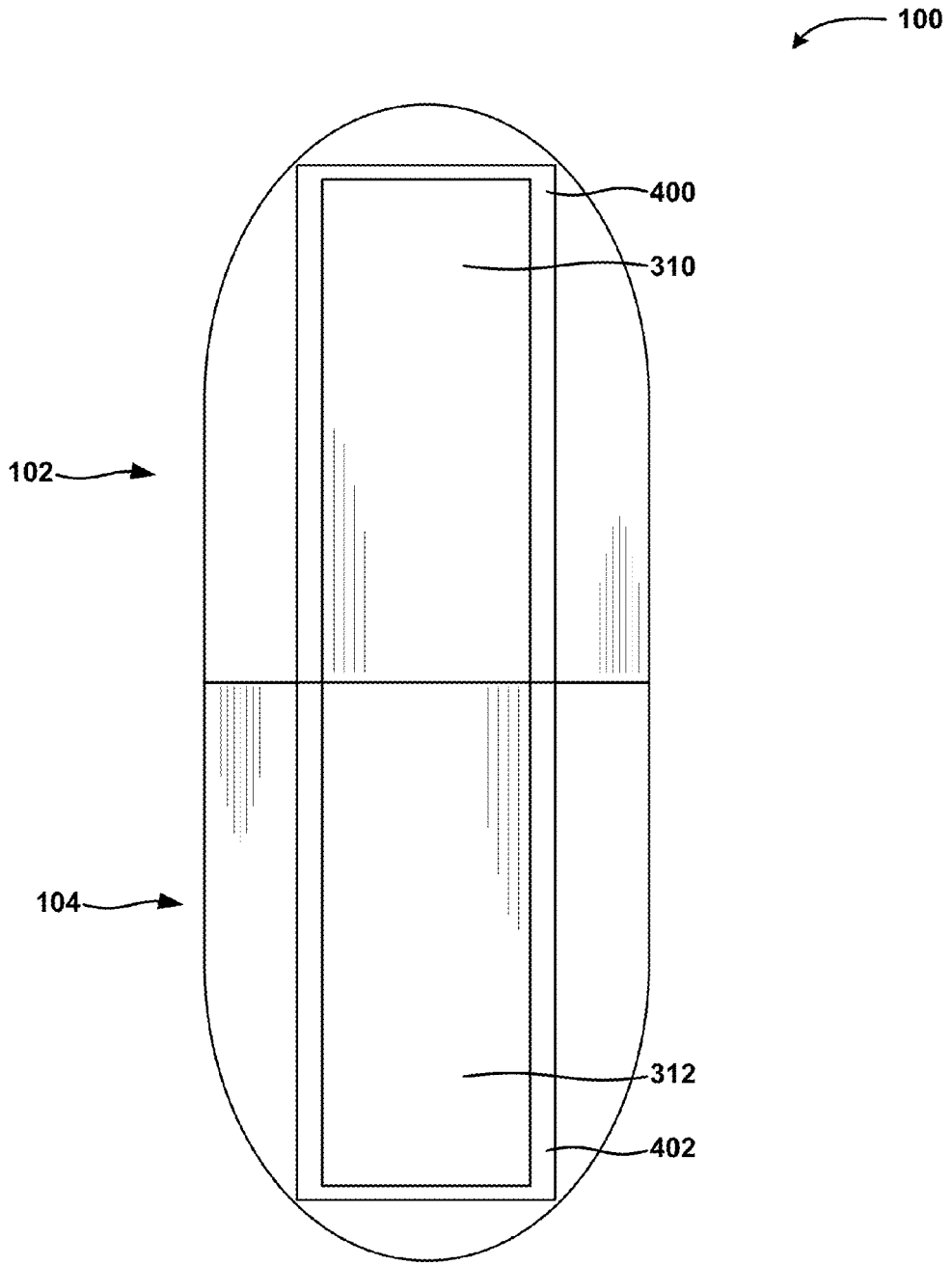
FIG. 4 is a line drawing illustrating some features of hair straighteners, according to some illustrative embodiments of the concepts and technologies described herein.

Turning now to FIG. 4, additional aspects of the concepts and technologies described herein for a hair straightener 100 will be described in detail. In particular, FIG. 4 is a top or bottom elevation view of the hair straightener 100 in an opened configuration. It should be understood that the top portion 102 and the bottom portion 104 illustrated in FIG. 4 may not be connected to one another in the illustrated configuration. In particular, a hinge 304, the top lining 306 and/or the bottom lining 308, or other components of the hair straightener 100 may limit rotation of the top portion 102 and/or the bottom portion 104 such that the illustrated configuration may not be possible once the hair straightener 100 is assembled. As such, it should be understood that the illustrated configuration is provided for the purpose of illustrating and describing the concepts and technologies described herein and therefore should not be construed as being limiting in any way.

As shown in FIG. 4 the top portion 102 can include a top portion heating plate insulator 400. The top portion heating plate insulator 400 can be located between the top heating plate 310 and a bottom surface of the top portion 102. Thus, it can be appreciated that the top portion heating plate insulator 400 can be provided to insulate heat from the top heating plate 310 and/or the bottom heating plate 312 from the top portion 102, structures and/or components thereof, and/or fingers of a hand 200 of a user inserted into the top portion 102.

As shown in FIG. 4 the bottom portion 104 can include a bottom portion heating plate insulator 402. The bottom portion heating plate insulator 402 can be located between the bottom heating plate 312 and a top surface of the bottom portion 104. Thus, it can be appreciated that the bottom portion heating plate insulator 402 can be provided to insulate heat from the bottom heating plate 312 and/or the top heating plate 310 from the bottom portion 104, structures and/or components thereof, and/or a thumb of a hand 200 of a user inserted into the bottom portion 104.

One or more of the top portion heating plate insulator 400 and the bottom portion heating plate insulator 402 can be formed from various insulating materials such as, for example, foils, silicon, thinsulate or other synthetic fiber insulation, rubber, various polymers, TEFLON brand materials, glass-filled and/or ceramic-filled NYLONs or other materials, epoxies, or the like. According to various embodiments, one or more of the top portion heating plate insulator 400 and the bottom portion heating plate insulator 402 can be formed as rigid, semi-rigid, semi-flexible, and/or flexible surfaces. As such, it should be understood that various insulating materials can be used for one or more of top portion heating plate insulator 400 and the bottom portion heating plate insulator 402 without departing from the scope of the concepts and technologies described herein.

Figure 5:
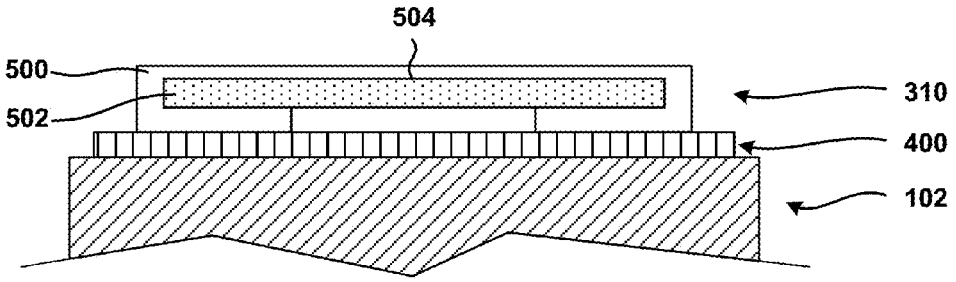
FIG. 5 is a line drawing illustrating some features of hair straighteners, according to some illustrative embodiments of the concepts and technologies described herein.

Turning now to FIG. 5, additional aspects of the concepts and technologies described herein for a hair straightener 100 will be described in detail. In particular, FIG. 5 is a side elevation view of part of the top portion 102, according to one example embodiment of the concepts and technologies described herein. It should be understood that illustrated embodiment is illustrative of one contemplated embodiment and therefore should not be construed as being limiting in any way.

As shown in FIG. 5, the top heating plate 310 can include one or more components. In the illustrated embodiment, the top heating plate 310 can include a heating element housing 500. The heating element housing 500 can be configured to receive, secure, and/or otherwise house a heating element 502. The heating element housing 500 can be made from ceramics; metals or alloys such as aluminum, steel, brass, or the like; or other materials. As can be seen in FIG. 5, the heating element housing 500 can include a sleeve, holster, or hollow ("sleeve") 504 in which the heating element 502 can be disposed or located.

In some embodiments of the heating element housing 500, the heating element 502 can be permanently mounted in the sleeve 504. For example, the heating element 502 can be attached to the heating element housing 500 using one or more of adhesive, a mechanical fastener, a chemical bonding process, or the like. Additionally, or alternatively, the heating element 502 may be thermally bonded or welded to the heating element housing 500, in some embodiments. It should be understood that these examples are illustrative and therefore should not be construed as being limiting in any way.

In some other embodiments, the heating element 502 can be semi-permanently located or disposed within the sleeve 504. For example, the heating element 502 can be attached to the heating element housing 500 using a releasable bond or adhesive. In some other embodiments, the heating element 502 can be joined or attached to the heating element housing 500 using a bond, adhesive, or fastener that may require a process, solvent, or machining to remove and as such, may be considered semi-permanently bonded. It should be understood that these examples are illustrative and therefore should not be construed as being limiting in any way.

In yet other embodiments, the heating element 502 may be removable located or disposed within the heating element housing 500. For example, the heating element 502 may be attached to the heating element housing 500 using a removable mechanical fastener such as a screw, pin, clamp, or the like. In yet other embodiments, an access to the sleeve 504 can be exposed when the heating element 502 is inserted into the sleeve 504 and blocked after assembly. Thus, for example, a pocket, passageway, or the like can be provided within one or more portions of the hair straightener 100, and the heating element 502 can be passed through the pocket, passageway, or the like into the sleeve 504, after which the pocket, passageway, or the like can be sealed. It should be understood that these examples are illustrative and therefore should not be construed as being limiting in any way.

Although FIG. 5 is illustrated and described with respect to the top portion 102 and the various components thereof (e.g., the top heating plate 310, the top portion heating plate insulator 400, etc.), it should be understood that the bottom portion 104 and/or the bottom heating plate 312 can be similarly configured, though this is not necessarily the case. Thus, it should be understood that the bottom heating plate 312 of the bottom portion 104 can be configured in a manner that is similar or even identical to the configuration of the top heating plate 310 of the top portion 102. It should be understood that this example is illustrative and therefore should not be construed as being limiting in any way.

Figure 6:
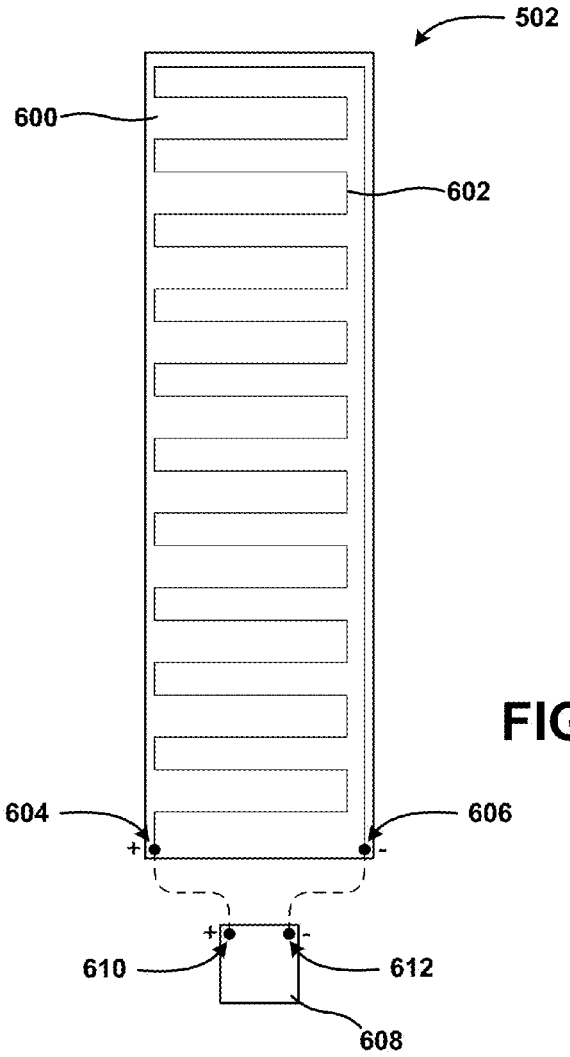
FIG. 6 is a line drawing illustrating some features of a heating element for hair straighteners, according to some illustrative embodiments of the concepts and technologies described herein.

Turning now to FIG. 6, additional aspects of the concepts and technologies described herein for a hair straightener 100 will be described in detail. In particular, FIG. 6 illustrates a heating element 502, according to some example embodiments of the concepts and technologies described herein. It should be understood that the example heating element 502 shown in FIG. 6 is illustrative and therefore should not be construed as being limiting in any way.

As shown in FIG. 6, the heating plate can be formed in some embodiments from a substrate 600. The substrate 600 can be formed from one or more metals or alloys; glasses, ceramics, porcelains, or the like; plastics, thermoplastics, other polymers, or the like; and/or combinations thereof. In some embodiments, the substrate 600 can be formed from a material that may conduct heat efficiently such as copper, aluminum, steel, ceramic, other metals, other alloys, other glasses, plastics, combinations thereof, or the like. The material used to form the substrate 600 can be rigid, semi-rigid, semi-flexible, or flexible.

The heating element 502 also can include a conductive coil 602. It can be appreciated that the conductive coil 602 can be attached to the substrate 600, formed in the substrate 600, and/or otherwise located at the substrate 600. In some embodiments, for example, the substrate 600 can be formed from a metal or alloy, and the conductive coil 602 can be attached to the substrate 600 using an adhesive and/or other mechanical, chemical, or other bonding processes. In some other embodiments, the substrate 600 can be formed from a ceramic, and the conductive coil 602 can be formed inside of the substrate 600. In yet other embodiments, a recess can be formed in the substrate 600 and the conductive coil 602 can be disposed within the recess. Because there are various approaches that may be used to locate the conductive coil 602 at the substrate 600, it should be understood that these examples are illustrative and therefore should not be construed as being limiting in any way.

As shown in FIG. 6, the heating element 502 also can include a positive electrical connector 604 and a negative electrical connector 606. Thus, a current can be applied across the conductive coil 602 and the conductive coil 602 can be heated by resistance. As such, it can be appreciated that the conductive coil 602 can be formed by a conductive, yet resistive material such as steel, tungsten, aluminum, copper, other materials, or the like. Furthermore, it should be understood that the conductive coil 602 can be printed on the substrate 600, in some embodiments, so it should be understood that the conductive coil 602 can be formed from a conductive ink. It should be understood that these examples are illustrative and therefore should not be construed as being limiting in any way.

According to various embodiments, a current can be applied to the conductive coil 602 via the positive electrical connector 604 and a negative electrical connector 606 by a power source 608. Various embodiments of the concepts and technologies described herein can include various types of power sources 608. For example, the power source 608 can include an electrical outlet, and as such the power may be supplied by a utility company, an on-site generator, a vehicle, or the like. As such, it should be understood that the hair straightener 100 can be joined to the power source 608 by an electrical cord (not shown in the FIGURES). It should be understood that this example is illustrative and therefore should not be construed as being limiting in any way.

In some other embodiments, the power source 608 can be internal to the hair straightener 100. As such, it should be understood that the power source 608 can include one or more battery. The one or more battery can include a disposable battery, a rechargeable battery, a renewable battery, combinations thereof, or the like. It should be understood that in some embodiments a battery may be inefficient for purposes of heating a conductive coil 602 as illustrated and described herein. As such, some embodiments of the hair straightener 100 can include an internal power source 608, an external power source 608, and/or an electrical bypass switch. The electrical bypass switch can be used to bypass the internal power source 608 when the external power source 608 is in use and/or to bypass power to a charging mechanism to charge the internal power source 608 when the hair straightener 100 is not in use and/or when the hair straightener 100 is in use. It should be understood that these examples are illustrative and therefore should not be construed as being limiting in any way.

Regardless of how the power source 608 is configured, and regardless of whether the power source 608 is configured as an alternating current or direct current device, the power source 608 can include a positive power source lead 610 and a negative power source lead 612. The positive power source lead 610 can be connected to the positive electrical connector 604 of the heating element 502, and the negative power source lead 612 can be connected to the negative electrical connector 606 of the heating element 502. The connection between the positive power source lead 610 and the positive electrical connector 604 can be provided by an electrical cable, wiring, conductive traces or the like. Similarly, the connection between the negative power source lead 612 and the negative electrical connector 606 can be provided by an electrical cable, wiring, conductive traces or the like. It should be understood that these examples are illustrative and therefore should not be construed as being limiting in any way.

Figure 7:
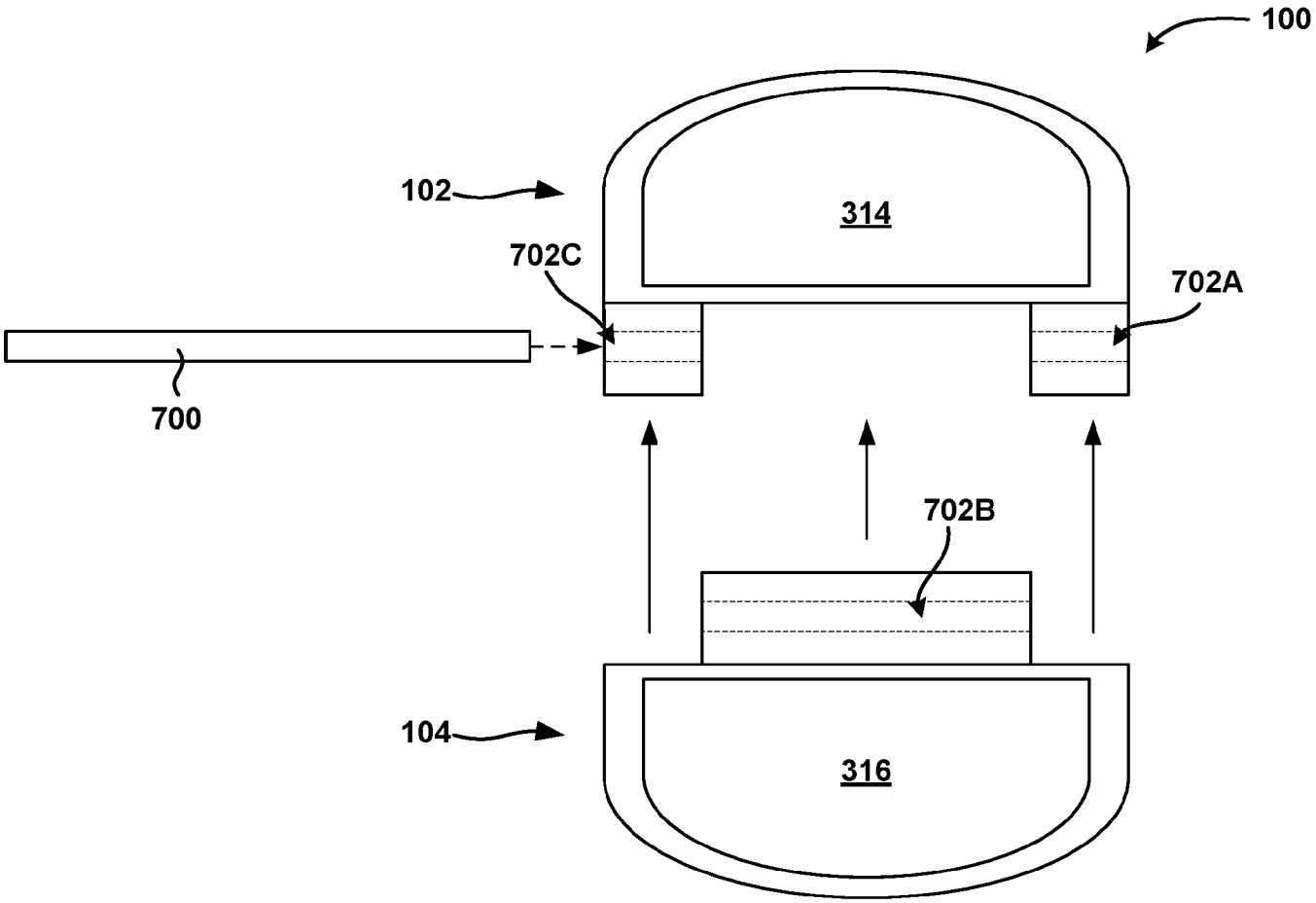
FIG. 7 is an assembly drawing illustrating some features of a hair straightener, according to some illustrative embodiments of the concepts and technologies described herein.

Turning now to FIG. 7, additional aspects of the hair straightener 100 according to various embodiments of the concepts and technologies described herein will be described in detail. In particular, FIG. 7 illustrates an assembly drawing of a hair straightener 100 according to another embodiment. It should be understood that the illustrated and described illustrative embodiment of the hair straightener 100 is one illustrative embodiment of the concepts and technologies described herein, and therefore should not be construed as being limiting in any way of the concepts and technologies described herein.

In some embodiments, as mentioned above and as shown in FIG. 7, the hair straightener 100 can include an assembly formed by joining together the top portion 102 and the bottom portion 104. The top portion 102 can be configured to be engaged, attached to, connected to, mated to, joined to, and/or otherwise assembled with the bottom portion 104. In some other embodiments, the top portion 102 and the bottom portion 104 can be formed as a solid and/or unitary structure, though this embodiment is not shown in FIG. 7.

As shown in FIG. 7, the top portion 102 and the bottom portion 104 can be assembled together using an assembly mechanism 700. The assembly mechanism 700 can include, for example, a pin, a bolt, a rivet, a screw, a latch, and/or other mechanisms. In one contemplated embodiment, the assembly mechanism 700 includes a pin that can be inserted through one or more assembly mechanism passageways 702A-702C. It therefore can be appreciated that the assembly mechanism 700 and the assembly mechanism passageways 702A-702C can collective provide the functionality associated with the hinge 304 illustrated and described above. It should be understood that this example is illustrative and therefore should not be construed as being limiting in any way.

According to various embodiments of the concepts and technologies described herein, the assembly mechanism 700 can be removable and/or can be removed from the hair straightener 100. The one or more assembly mechanism passageways 702A-702C can cooperatively form a single assembly passageway, though this is not necessarily the case. In particular some embodiments of the concepts and technologies described herein include omitting portions of one or more of the assembly mechanism passageways 702A-702C, omitting one or more of the assembly mechanism passageways 702A-702C, combining one or more of the assembly mechanism passageways 702A-702C, or the like. As such, the illustrated embodiment should be understood as one example embodiment and should not be construed as being limiting in any way.

In some embodiments, the assembly mechanism 700 can be inserted through the one or more assembly mechanism passageways 702A-702C (and/or the assembly passageway), and a securing mechanism such as a lynchpin, nut, or the like can be attached to the assembly mechanism 700 to hold the assembly mechanism in position. Additionally, or alternatively, if a permanent or semi-permanent fastener is used as the assembly mechanism 700, the assembly mechanism 700 can be inserted into the assembly mechanism passageways 702A-702C (and/or the assembly passageway), and the assembly mechanism 700 can be deformed, welded, and/or otherwise permanently or semi-permanently locked into position. According to various embodiments, the assembly mechanism 700 and one or more of the assembly mechanism passageways 702A-702C can be formed from a polymer, and as such one or more the assembly mechanism and the assembly mechanism passageways 702A-702C can be thermoformed to permanently and/or semi-permanently join the top portion 102 to the bottom portion 104. It should be understood that this example is illustrative and therefore should not be construed as being limiting in any way. Because various types of fasteners that can be used as the assembly mechanism 700 are generally understood, the assembly mechanism 700 will not be described in further detail.

Although not visible in FIG. 7, it should be understood that a spring or spring mechanism can be located between the top portion 102 and the bottom portion 104 in some embodiments. In some other embodiments, the top portion 102 and the bottom portion 104 can be formed as a single part and can be formed such that a spring force is applied to the top portion 102 and the bottom portion 104 without adding separate springs. This will be more clearly understood with reference to FIG. 8A below.

As mentioned above, the hair straightener 100 and/or the components of the hair straightener 100 (e.g., the top portion 102, the bottom portion 104, and/or the assembly mechanism 700) can be formed from various materials. According to various embodiments of the concepts and technologies described herein, the hair straightener 100, or portions or components thereof, can be formed from metals and/or metal alloys such as steel, aluminum, titanium, brass, copper, magnesium alloys, aluminum alloys, other metals or alloys, combinations thereof, or the like.

In some embodiments, one or more components of the hair straightener 100 can be formed from non-metal and/or non-metal-alloy materials such as resins, polymers, and/or other materials. In some embodiments, for example, the hair straightener 100, or a portion thereof, can be formed from resins such as epoxy resins, or the like. In some embodiments, for example, the hair straightener 100, or a portion thereof, can be formed from one or more polymers such as various thermoplastics, polypropylene, polycarbonates, aerogel, graphite filled NYLON, phenolics, polyimides, and/or other polymers, combinations thereof, or the like. Because the hair straightener 100 can be formed from additional and/or alternative materials, it should be understood that these examples are illustrative and therefore should not be construed as being limiting in any way.

In some embodiments, one or more surfaces of the hair straightener 100 and/or the components of the hair straightener 100 (e.g., the top portion 102, the bottom portion 104, and/or the assembly mechanism 700) can be painted, dyed, coated, or otherwise treated for decorative and/or functional purposes. According to various embodiments of the concepts and technologies described herein, the hair straightener 100 and/or the components of the hair straightener 100 (e.g., the top portion 102, the bottom portion 104, and/or the assembly mechanism 700) can be polished, sandblasted, painted, coated, or otherwise treated to provide a color, and/or to provide a tactile finish to the surface. Thus, for example, the surface can be smooth, semi-smooth, and/or unsmooth to provide various surface appearances and/or to make the surfaces easier to grip by a user. Because additional and/or alternative treatment processes are possible and are contemplated, it should be understood that these examples are illustrative and therefore should not be construed as being limiting in any way.

Figure 8A:
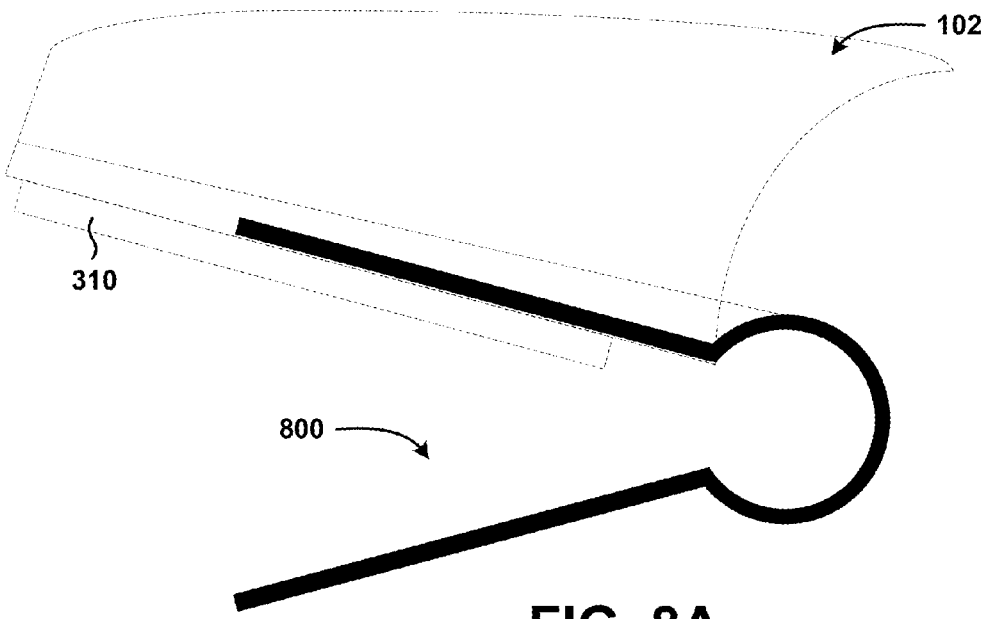
FIGS. 8A-8B illustrate some example spring mechanisms that can be used with a hair straightener, according to some illustrative embodiments of the concepts and technologies described herein.
Figure 8B:
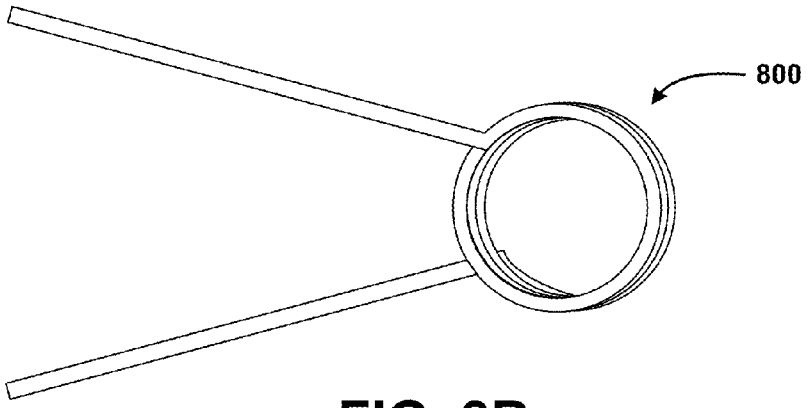

Referring now to FIGS. 8A-8B, additional aspects of the concepts and technologies described herein for a hair straightener 100 will be described in detail. In particular, FIG. 8A illustrates a side elevation view of a spring mechanism 800 that can be used in various embodiments of the concepts and technologies described herein. As can be seen in FIG. 8A, the spring mechanism 800 can be located within the hair straightener 100. According to some embodiments, the spring mechanism 800 can provide the functionality of the hinge 304 as well as a spring.

In particular, the spring mechanism 800 can be formed from a single piece of material such as steel, nickel, or the like, and can provide a springing force that can push the top portion 102 away from the bottom portion 104, or pull the top portion 102 toward the bottom portion 104. Thus, some embodiments of the hair straightener 100 illustrated and described herein can include the spring mechanism 800 shown in FIG. 8A and can be operated by a user by either applying a force to separate the top portion 102 from the bottom portion 104 (and thereby create a gap between the top heating plate 310 and the bottom heating plate 312), or by applying a force to move the top portion 102 toward the bottom portion 104 (and thereby closing a gap between the top heating plate 310 and the bottom heating plate 312). It should be understood that these examples are illustrative and therefore should not be construed as being limiting in any way.

Only the top portion 102 is shown in FIG. 8A so as not to obscure the view of the spring mechanism 800. It should be understood that the bottom portion 104 can be located in an arrangement that may be similar to the arrangement in which the top portion 102 is located, albeit in a mirror-image arrangement. It should be understood that this example is illustrative and therefore should not be construed as being limiting in any way.

Turning now to FIG. 8B, another embodiment of a spring mechanism 800 that can be used in accordance with various embodiments of the concepts and technologies described herein for a hair straightener 100 is shown. As can be seen in FIG. 8B, the spring mechanism 800 can be provided by a spring. The spring mechanism 800 shown in FIG. 8B can be located within a hinge such as the hinge 304, in some embodiments. In some other embodiments, the spring mechanism 800 shown in FIG. 8B can be disposed between the top portion 102 and the bottom portion 104.

Regardless of where the spring mechanism 800 is located, the spring mechanism 800 shown in FIG. 8B may, as described above with regard to the spring mechanism 800 shown in FIG. 8A, provide a springing force that can push the top portion 102 away from the bottom portion 104 or pull the top portion 102 toward the bottom portion 104. Thus, some embodiments of the hair straightener 100 illustrated and described herein can include the spring mechanism 800 shown in FIG. 8B and can be operated by a user by either applying a force to separate the top portion 102 from the bottom portion 104 (and thereby create a gap between the top heating plate 310 and the bottom heating plate 312), or by applying a force to move the top portion 102 toward the bottom portion 104 (and thereby closing a gap between the top heating plate 310 and the bottom heating plate 312). It should be understood that these examples are illustrative and therefore should not be construed as being limiting in any way.

Figure 9:
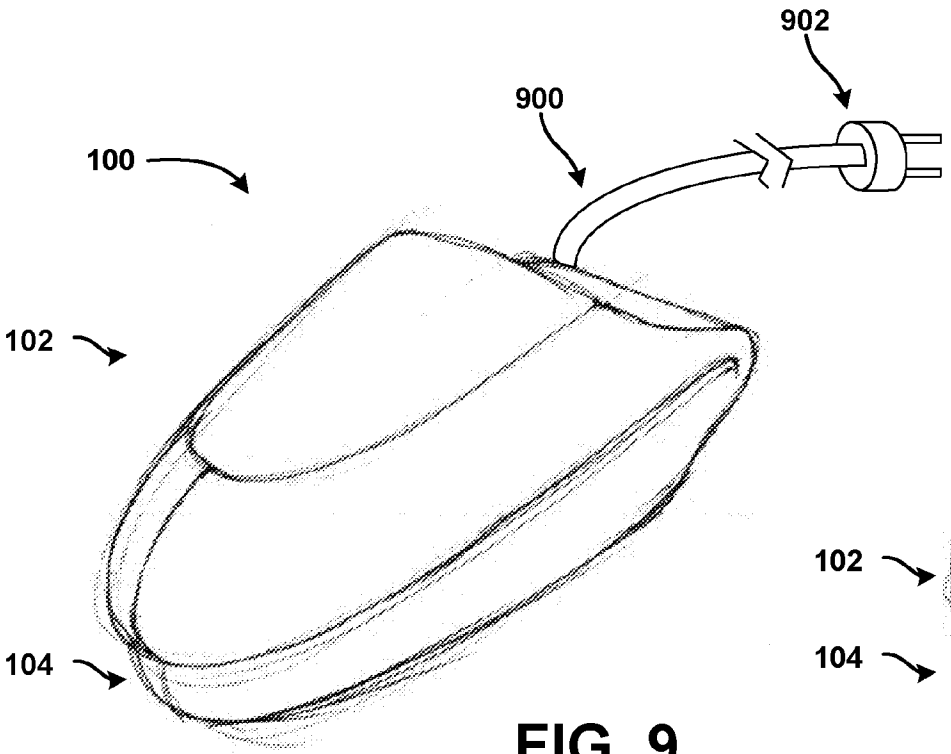

Turning now to FIGS. 9-24, additional aspects of the concepts and technologies described herein for a hair straightener 100 will be described in detail. Turning first to FIG. 9, a perspective view of a hair straightener 100 is shown, according to some illustrative embodiments. As shown in FIG. 9, the top portion 102 and/or the bottom portion 104 of the hair straightener 100 can be formed from soft silicone or other materials. In the illustrated embodiment, soft silicone is used, and the top portion 102 and the bottom portion 104 are formed from a single piece of silicone. Other components of the hair straightener 100 can be formed from various materials including rigid, semi-rigid, semi-flexible, and/or flexible materials. In some embodiments, the soft silicone may be a preferred material because the soft silicone may be waterproof.

Also shown in FIG. 9 is one embodiment of the power source illustrated and described herein. In particular, FIG. 9 illustrates an illustrative power cord 900. As generally is understood, the power cord 900 can be of various lengths and/or configurations, and can include a plug 902 or other structures for coupling the hair straightener 100 to a source of power such as a battery source, a power outlet, or the like. While the illustrated plug 902 includes only two prongs, it should be understood that any number of prongs may be included to accommodate grounded and/or multi-phase power sources. As such, it should be understood that the illustrated example is illustrative and therefore should not be construed as being limiting in any way.

Figure 10:
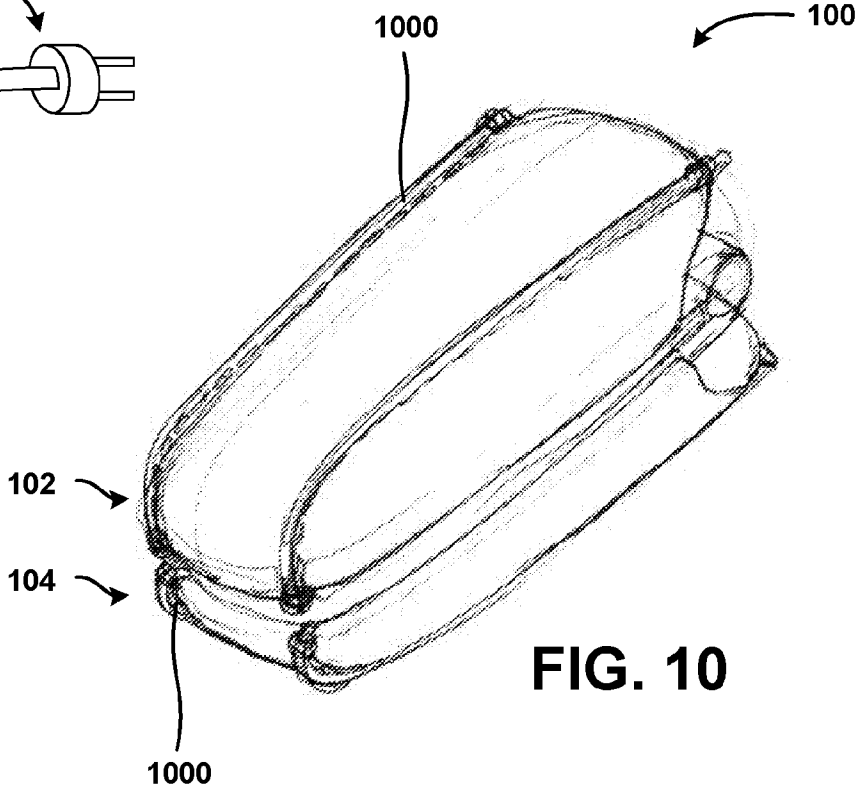
FIGS. 9-12 are line drawings showing perspective views of some example hair straighteners, according to various embodiments of the concepts and technologies described herein.

Turning now to FIG. 10, a perspective view of a hair straightener 100 is shown, according to some illustrative embodiments. As shown in FIG. 10, the top portion 102 and/or the bottom portion 104 of the hair straightener 100 can be formed from a fabric, leather, synthetic leather, and/or other materials that may be stitched together. In the illustrated embodiment, the materials can be stitched together using one or more decorative stitches 1000. Other components of the hair straightener 100 can be formed from various materials including rigid, semi-rigid, semi-flexible, and/or flexible materials. It should be understood that this example is illustrative and therefore should not be construed as being limiting in any way.

Figure 11:
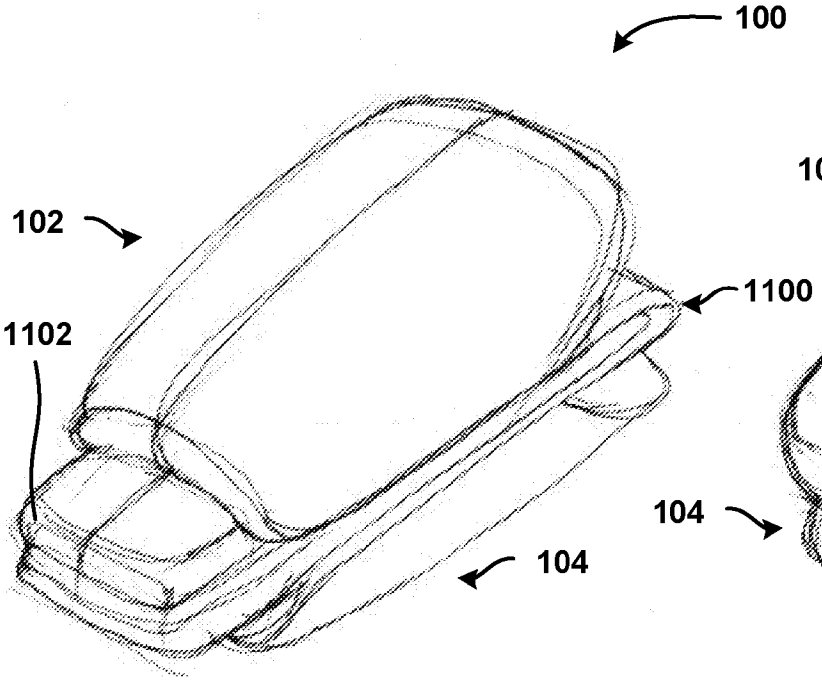

Turning now to FIG. 11, a perspective view of a hair straightener 100 is shown, according to some illustrative embodiments. As shown in FIG. 11, the top portion 102 and/or the bottom portion 104 of the hair straightener 100 can be formed from soft silicone, fabric, hard plastic, leather, or other materials. In the illustrated embodiment, soft silicone is used, though this is not necessarily the case. In the embodiment shown in FIG. 11, a hard plastic, metal, or other material can be included to provide a spring and/or hinge assembly ("spring/hinge assembly") 1100. Thus, the top portion 102 and the bottom portion 104 can be held together and/or sprung apart or together by the spring/hinge assembly 1100.

The embodiment shown in FIG. 11 also includes an inner 1102 that can be formed from a rigid material such as metal, wood, bamboo, hard plastic, other materials, combinations thereof, or the like. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 12:
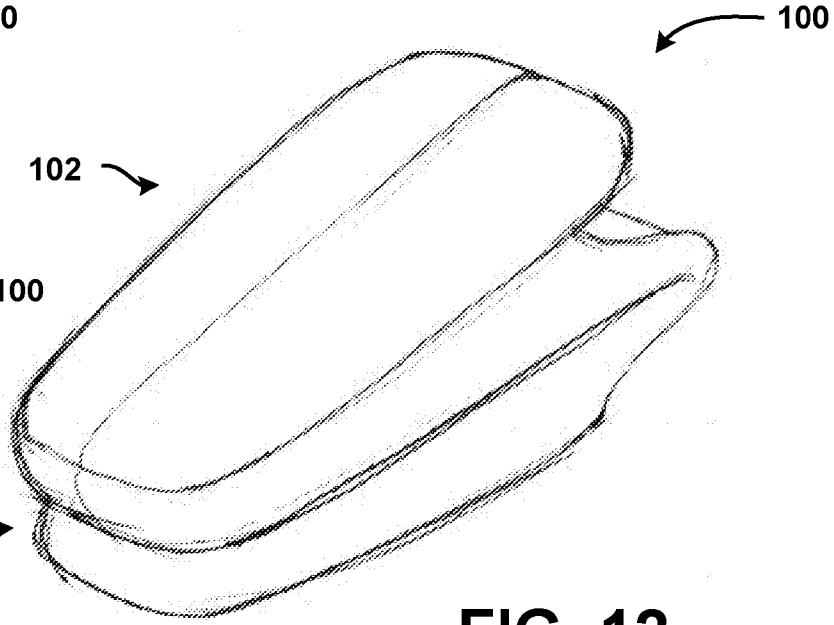

Turning now to FIG. 12, a perspective view of a hair straightener 100 is shown, according to another illustrative embodiment. As shown in FIG. 12, the top portion 102 and/or the bottom portion 104 of the hair straightener 100 can be formed from soft silicone. It therefore can be appreciated that the embodiment of the hair straightener 100 shown in FIG. 12 can be similar to the embodiment of the hair straightener 100 shown in FIG. 9, albeit with a different shape and/or configuration. Other components of the hair straightener 100 can be formed from various materials including rigid, semi-rigid, semi-flexible, and/or flexible materials. Although not visible in FIG. 9 or 12, an internal hinge can be included. It should be understood that the illustrated examples shown in FIGS. 9 and 12 are illustrative and therefore should not be construed as being limiting in any way.

Figure 13:
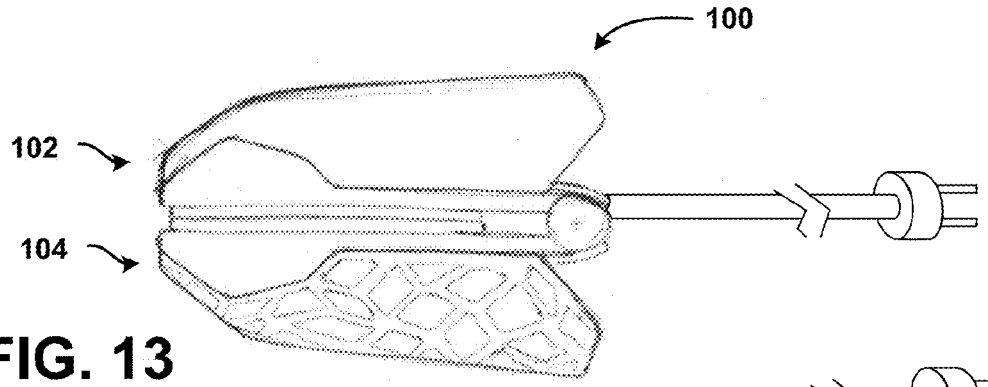
FIG. 13 is a line drawing showing a side elevation view of an example hair straightener, according to various embodiments of the concepts and technologies described herein.

FIG. 13, a side elevation view of a hair straightener 100 is shown, according to some illustrative embodiments. As shown in FIG. 13, one or more of the top portion 102 and/or the bottom portion 104 of the hair straightener 100 can be formed from molded silicone or other materials. In the illustrated embodiment, molded silicone is used to form the top portion 102 and the bottom portion 104, and decorative pattern can be formed in the bottom portion 104 using perforations and/or embossing. Although the top portion 102 is shown without the decorative pattern, it should be understood that this is not necessarily the case. It should be understood that the illustrated example is illustrative and therefore should not be construed as being limiting in any way.

Figure 14:
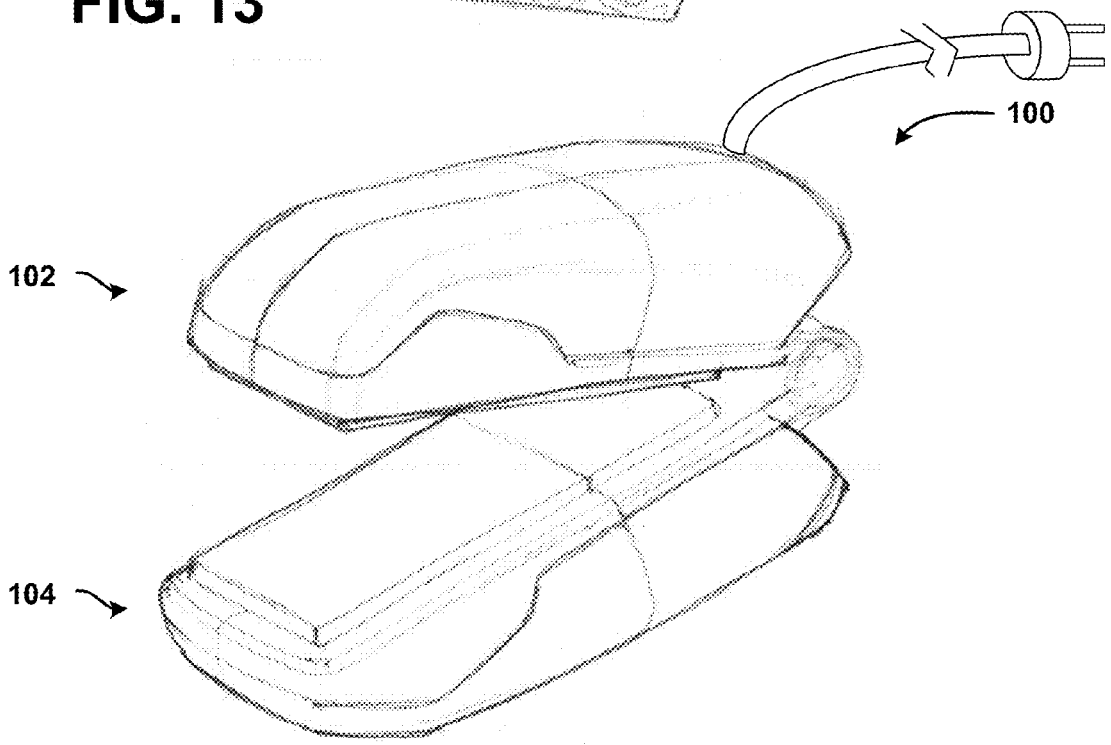
FIGS. 14-18 are line drawings showing perspective views of some example hair straighteners, according to various embodiments of the concepts and technologies described herein.

Turning now to FIG. 14, a perspective view of a hair straightener 100 is shown, according to some illustrative embodiments. As shown in FIG. 14, one or more of the top portion 102 and/or the bottom portion 104 of the hair straightener 100 can be formed from a hard material such as hard plastic, metal, polycarbonate, polyvinylchloride, other polymers, combinations thereof, or the like. In the illustrated embodiment, hard plastic is used. Other components of the hair straightener 100 can be formed from various materials including rigid, semi-rigid, semi-flexible, and/or flexible materials. It should be understood that the illustrated example is illustrative and therefore should not be construed as being limiting in any way.

Figures 15, 16:
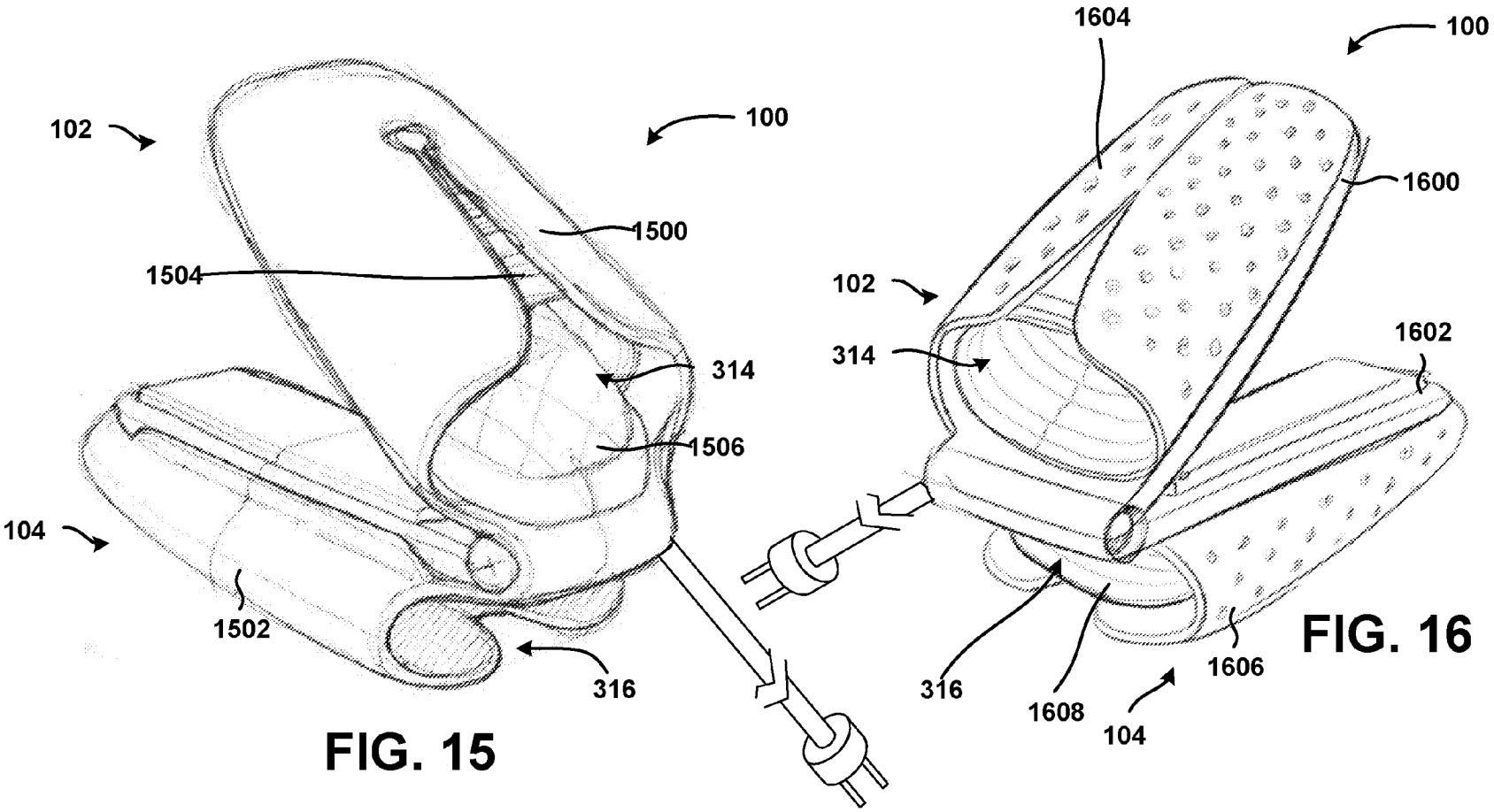

Turning now to FIG. 15, a perspective view of a hair straightener 100 is shown, according to some illustrative embodiments. As shown in FIG. 15, one or more of the top portion 102 and/or the bottom portion 104 of the hair straightener 100 can be formed from silicone, elastic, plastic, metal, alloys, polymers, combinations thereof, or the like. In the illustrated embodiment, one or more portions of the top portion 102 and the bottom portion 104 can be formed from silicone. In the illustrated embodiment, the top portion 102 and the bottom portion can include a silicone shell 1500, 1502. An inner elastic liner 1504 also can be included.

The inner elastic liner 1504 can be formed as part of or connected to one or more of the silicone shells 1500, 1502. Thus, the assembly of the inner elastic liner 1504 and the silicone shells 1500, 1502 can provide a compression fit (provided by the inner elastic liner 1504) to maintain the shape of the top portion 102 and/or the bottom portion 104, to hold the hand 200 in place with respect to the hair straightener 100 and/or to hold the hair straightener 100 in place with respect to the hand 200, and/or for other purposes. Other components of the hair straightener 100 can be formed from various materials including rigid, semi-rigid, semi-flexible, and/or flexible materials. In the illustrated embodiment, the hair straightener 100 includes a quilted insulated fabric pad lining 1506, though this is not necessarily the case. It should be understood that the illustrated example is illustrative and therefore should not be construed as being limiting in any way.

Turning now to FIG. 16, a perspective view of a hair straightener 100 is shown, according to some illustrative embodiments. As shown in FIG. 16, one or more of the top portion 102 and/or the bottom portion 104 of the hair straightener 100 can be formed from a flexible molded outer, a hard plastic base, and/or an insulated fabric liner. In the illustrated embodiment, one or more of the top portion 102 and the bottom portion 104 can include a hard plastic base 1600, 1602. The plastic base can support a flexible molded outer 1604, 1606, which can be formed from EVA foam, silicone, or other soft materials. Other components of the hair straightener 100 can be formed from various materials including rigid, semi-rigid, semi-flexible, and/or flexible materials. For example, the hair straightener 100 can include an insulated fabric pad liner 1608, though this is not necessarily the case. It should be understood that the illustrated example is illustrative and therefore should not be construed as being limiting in any way.

Figure 17:
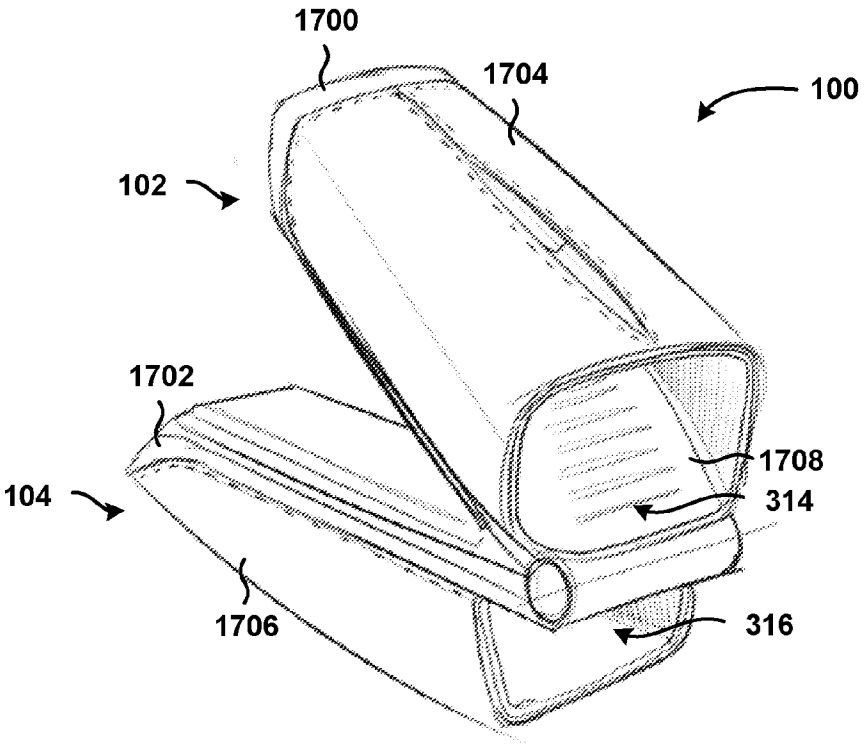

Turning now to FIG. 17, a perspective view of a hair straightener 100 is shown, according to some illustrative embodiments. As shown in FIG. 17, one or more of the top portion 102 and/or the bottom portion 104 of the hair straightener 100 can be formed from a hard plastic base, a fabric outer, and/or an insulated inner. In the illustrated embodiment, one or more of the top portion 102 and the bottom portion 104 can include a hard plastic base 1700, 1702. The plastic base can support a flexible outer 1704, 1706, which can be formed from a fabric or other materials. Other components of the hair straightener 100 can be formed from various materials including rigid, semi-rigid, semi-flexible, and/or flexible materials. For example, the hair straightener 100 can include an insulated inner 1708, though this is not necessarily the case. It should be understood that the illustrated example is illustrative and therefore should not be construed as being limiting in any way.

Figure 18:
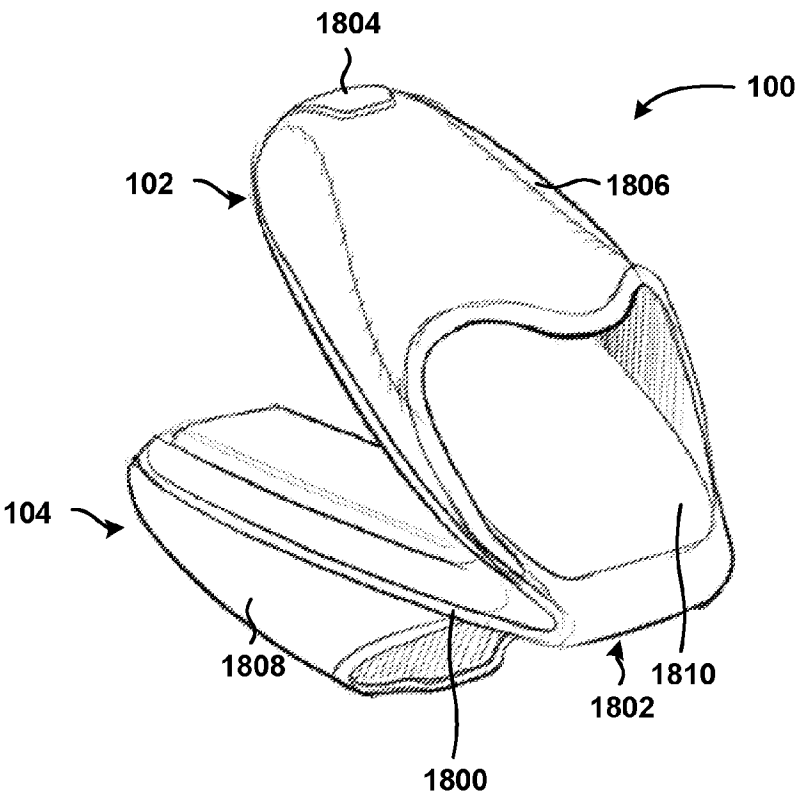

Turning now to FIG. 18, a perspective view of a hair straightener 100 is shown, according to some illustrative embodiments. As shown in FIG. 18, one or more of the top portion 102 and/or the bottom portion 104 of the hair straightener 100 can be formed from a flexible outer, a flexible base with an integrated hinge and toe cap, and/or an insulated liner pad. In the illustrated embodiment, one or more of the top portion 102 and the bottom portion 104 can include a flexible base 1800 that can have an integrated hinge (shown generally at 1802) and a toe cap 1804. The flexible base 1800 can support a flexible outer 1806, 1808, which in the illustrated embodiment can be formed from stitched neoprene or other soft materials. Other components of the hair straightener 100 can be formed from various materials including rigid, semi-rigid, semi-flexible, and/or flexible materials. For example, the hair straightener 100 can include an insulated liner pad 1810, though this is not necessarily the case. It should be understood that the illustrated example is illustrative and therefore should not be construed as being limiting in any way.

Figure 19:
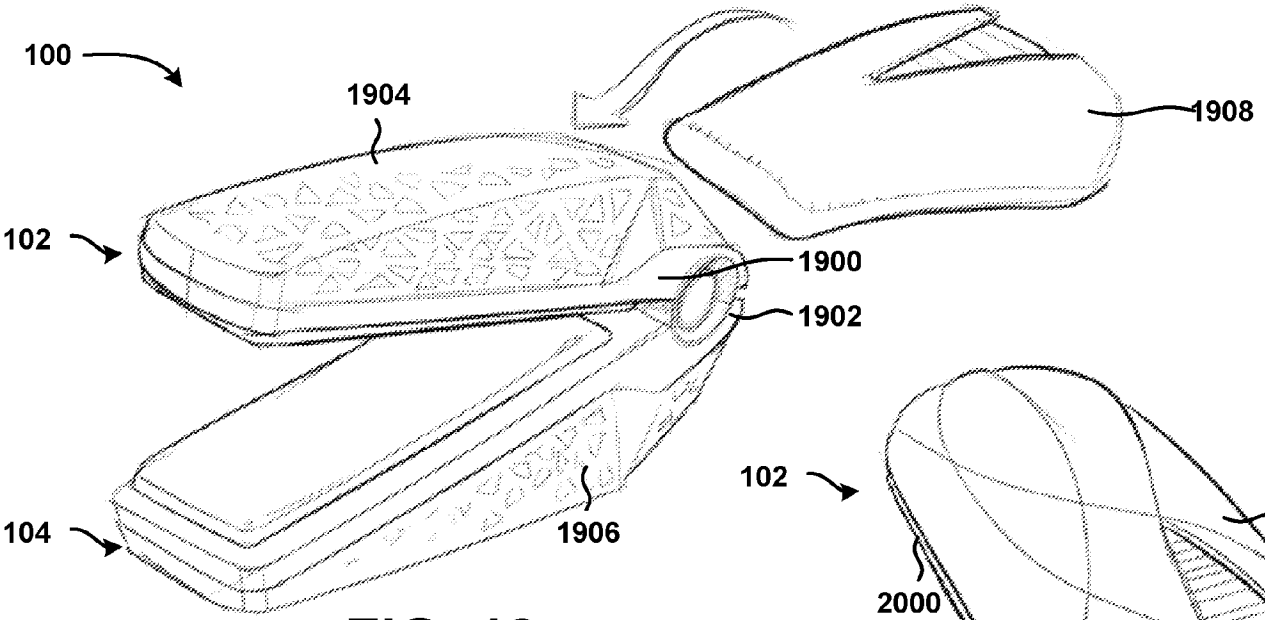
FIG. 19 is an assembly drawing illustrating some features of a hair straightener, according to an illustrative embodiment of the concepts and technologies described herein.

Turning now to FIG. 19, a perspective view of a hair straightener 100 is shown, according to some illustrative embodiments. As shown in FIG. 19, one or more of the top portion 102 and/or the bottom portion 104 of the hair straightener 100 can be formed from a soft silicone molded shell, a hard plastic base, and an insulated fabric liner. In the illustrated embodiment, one or more of the top portion 102 and the bottom portion 104 can include a hard plastic base 1900, 1902. The hard plastic base 1900, 1902 can support soft silicone molded shells 1904, 1906. The soft silicone molded shells 1904, 1906 can have a decorative perforated pattern, in some embodiments, though this is not necessarily the case.

The hair straightener 100 also can include an insulated fabric liner 1908, which can be attached to the hair straightener 100. In some embodiments, the insulated fabric liner 1908 can be configured to stretch-fit onto the top portion 102 and/or the bottom portion 104, though this is not necessarily the case. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 20:
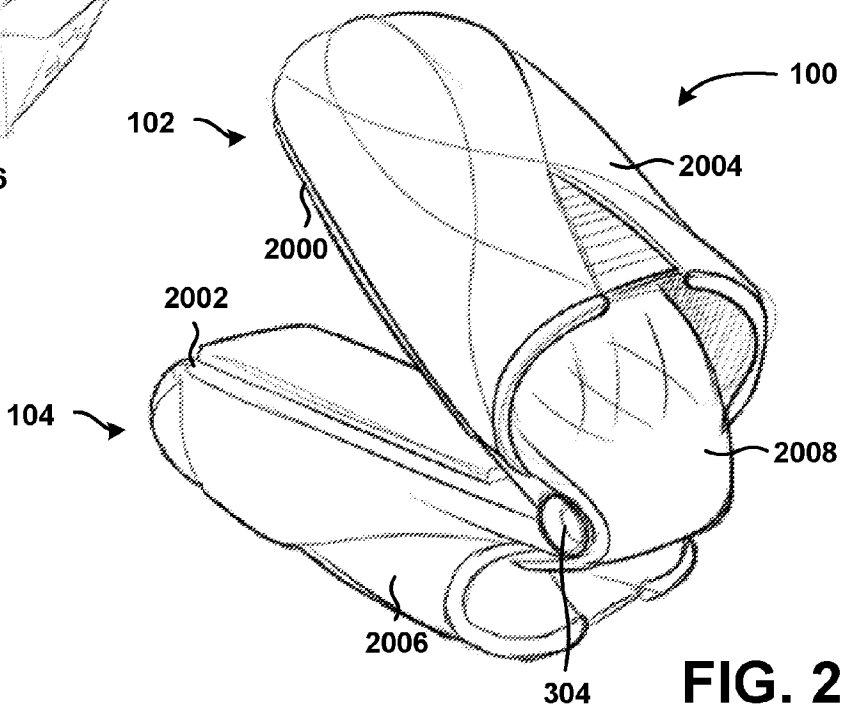
FIG. 20 is a line drawing showing a perspective view of the hair straightener, according to some embodiments of the concepts and technologies described herein.

Turning now to FIG. 20, a perspective view of a hair straightener 100 is shown, according to some illustrative embodiments. As shown in FIG. 20, one or more of the top portion 102 and/or the bottom portion 104 of the hair straightener 100 can be formed from a neoprene sleeve, a hard plastic base, and/or an insulated fabric inner. In the illustrated embodiment, one or more of the top portion 102 and the bottom portion 104 can include a hard plastic base 2000, 2002. The hard plastic base 2000, 2002 can support a fabric outer 2004, 2006, which can be formed from neoprene, fabric, or other materials. In the illustrated embodiment, the fabric outer 2004, 2006 can include a decorative quilt stitching. Other components of the hair straightener 100 can be formed from various materials including rigid, semi-rigid, semi-flexible, and/or flexible materials. For example, the hair straightener 100 can include an insulated fabric pad inner 2008, which can wrap around the hinge 304 to provide padding, or for other purposes. It should be understood that the illustrated example is illustrative and therefore should not be construed as being limiting in any way.

Figure 21:
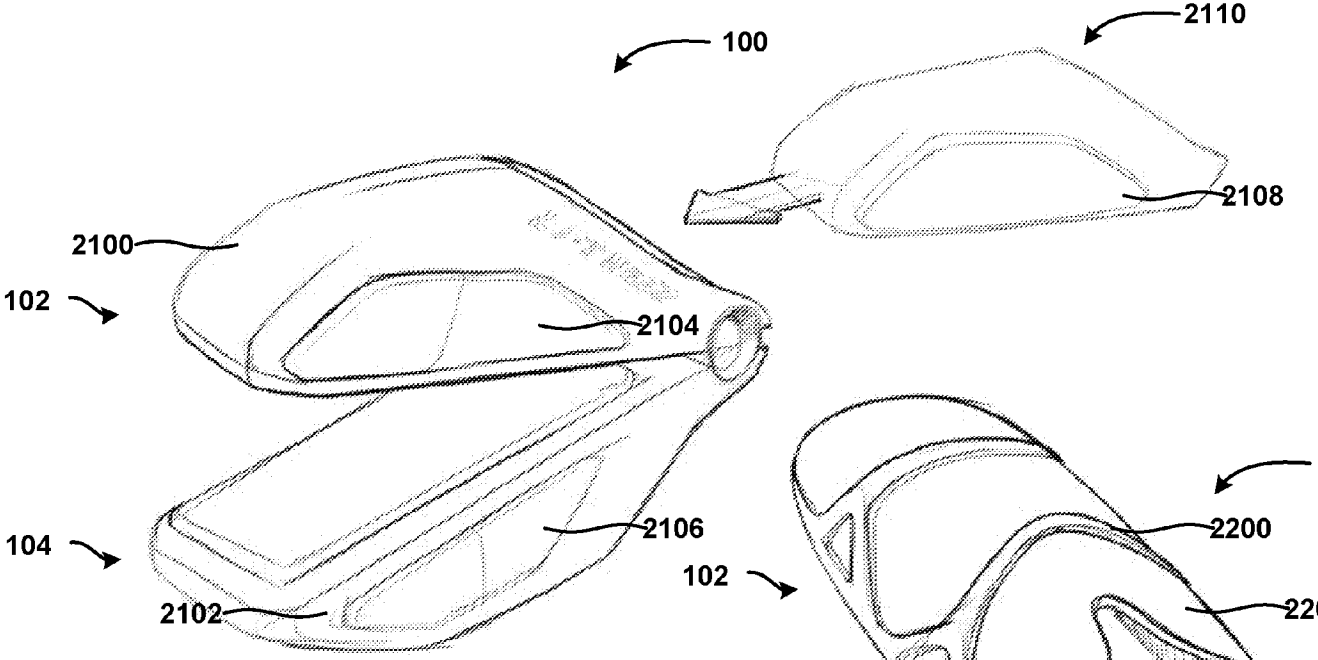
FIG. 21 is an assembly drawing illustrating some features of a hair straightener, according to an illustrative embodiment of the concepts and technologies described herein.

Turning now to FIG. 21, a perspective view of a hair straightener 100 is shown, according to some illustrative embodiments. As shown in FIG. 21, one or more of the top portion 102 and/or the bottom portion 104 of the hair straightener 100 can be formed from a molded outer and an insulated liner. In the illustrated embodiment, one or more of the top portion 102 and the bottom portion 104 can include molded outer 2100, 2102. The molded outers 2100, 2102 can include protrusions 2104, 2106, which can be configured to protrude through one or more apertures 2108 formed in an insulated liner 2110. Thus, the protrusions 2104, 2106 of the molded outers 2100, 2102 can engage the insulated liners 2110 to hold the insulated liners 2110 in position. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 22:
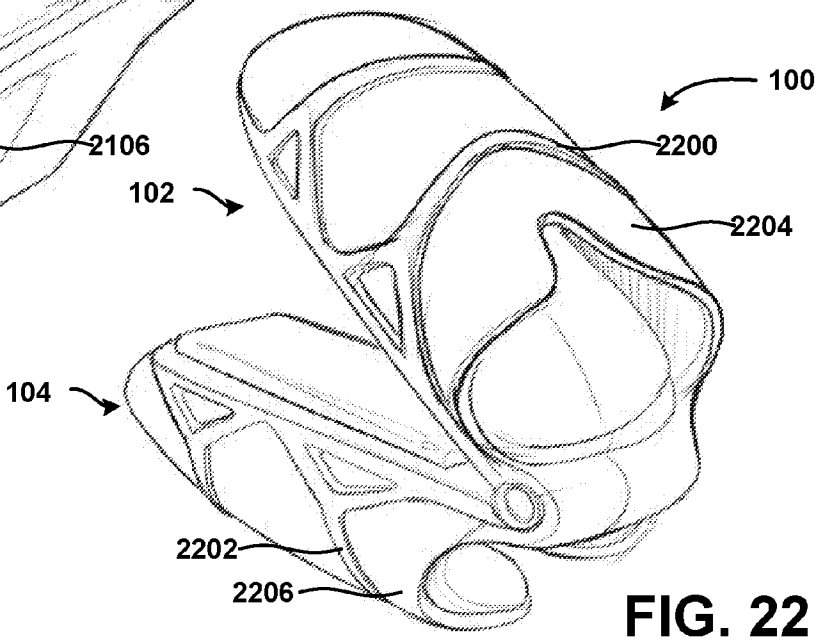
FIG. 22 is a line drawing showing a perspective view of the hair straightener, according to some embodiments of the concepts and technologies described herein.

Turning now to FIG. 22, a perspective view of a hair straightener 100 is shown, according to some illustrative embodiments. As shown in FIG. 22, one or more of the top portion 102 and/or the bottom portion 104 of the hair straightener 100 can be formed from a soft silicone inner and a hard plastic outer. In the illustrated embodiment, one or more of the top portion 102 and the bottom portion 104 can include a hard plastic cage outer 2200, 2202. The hard plastic cage outer 2200, 2202 can wrap around a soft silicone inner 2204, 2206. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 23:
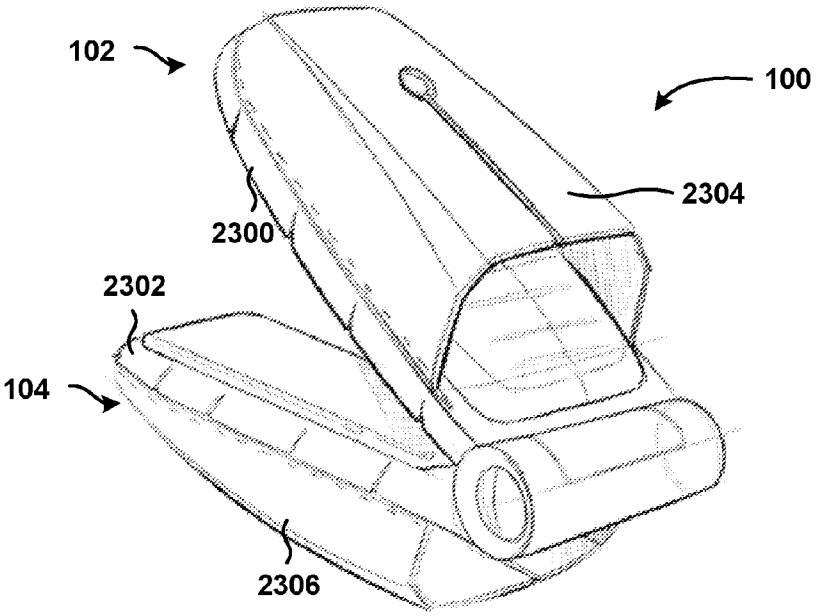

Turning now to FIG. 23, a perspective view of a hair straightener 100 is shown, according to some illustrative embodiments. As shown in FIG. 23, one or more of the top portion 102 and/or the bottom portion 104 of the hair straightener 100 can be formed from a molded silicone outer and a hard plastic and molded foam base. In the illustrated embodiment, one or more of the top portion 102 and the bottom portion 104 can include a molded EVA foam and rigid plastic base 2300, 2302. The molded EVA foam and rigid plastic bases 2300, 2302 can support a molded silicone upper 2304, 2306. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 24:
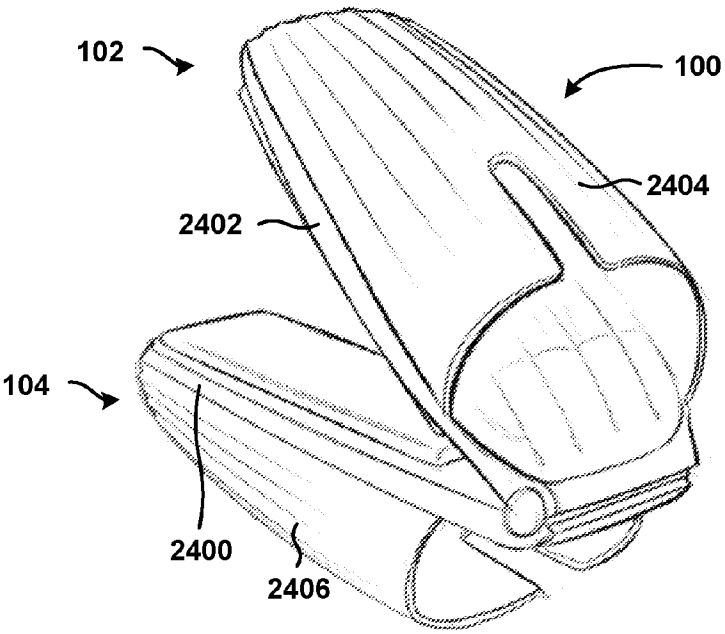
FIGS. 23-26 are line drawings showing perspective views of some example hair straighteners, according to various embodiments of the concepts and technologies described herein.

Turning now to FIG. 24, a perspective view of a hair straightener 100 is shown, according to some illustrative embodiments. As shown in FIG. 24, one or more of the top portion 102 and/or the bottom portion 104 of the hair straightener 100 can be formed from a hard plastic base and a molded silicone outer. In the illustrated embodiment, one or more of the top portion 102 and the bottom portion 104 can include a hard plastic base 2400, 2402. The hard plastic bases 2400, 2402 can support a molded silicone upper 2404, 2406. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 25:
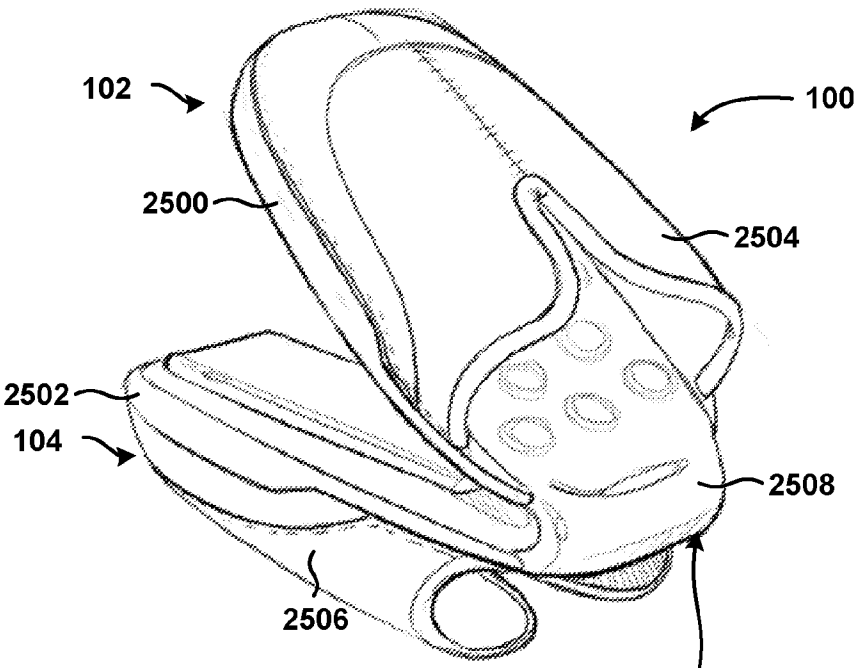

Turning now to FIG. 25, a perspective view of a hair straightener 100 is shown, according to some illustrative embodiments. As shown in FIG. 25, one or more of the top portion 102 and/or the bottom portion 104 of the hair straightener 100 can be formed from a stitched neoprene upper and a rigid plastic base plate. In the illustrated embodiment, one or more of the top portion 102 and the bottom portion 104 can include a rigid plastic base plate 2500, 2502. The rigid plastic base plates 2500, 2502 can support stitched neoprene uppers 2504, 2506. The hair straightener 100 also can include an insulting silicone inner pad 2508 that can wrap around to form a hinge 2510. Other components of the hair straightener 100 can be formed from various materials including rigid, semi-rigid, semi-flexible, and/or flexible materials. It should be understood that the illustrated example is illustrative and therefore should not be construed as being limiting in any way.

Figure 26:
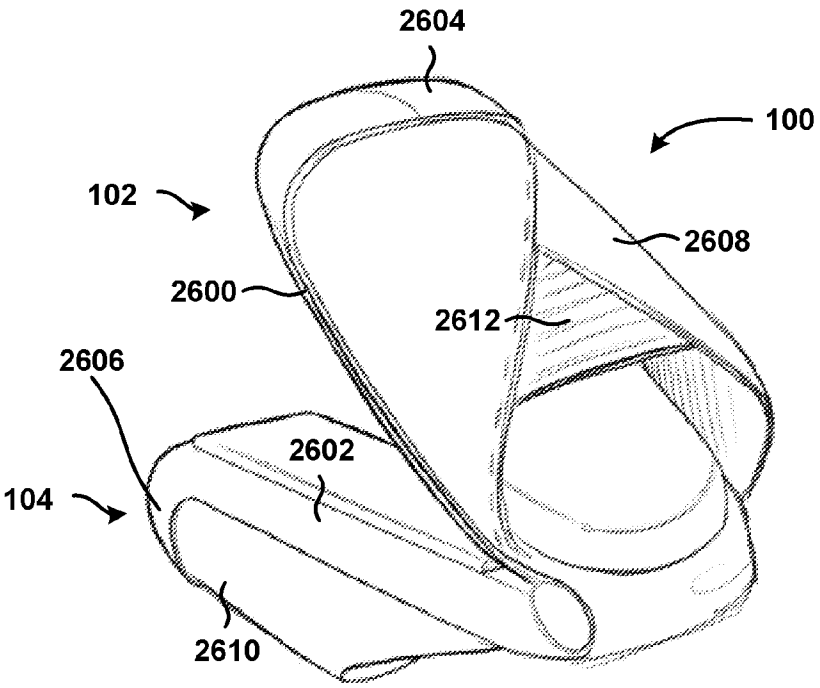

Turning now to FIG. 26, a perspective view of a hair straightener 100 is shown, according to some illustrative embodiments. As shown in FIG. 26, one or more of the top portion 102 and/or the bottom portion 104 of the hair straightener 100 can be formed from a fabric upper, a molded foam base having a toe cap, and a wrapped fabric upper with an elastic stretch zone. In the illustrated embodiment, one or more of the top portion 102 and the bottom portion 104 can include a molded EVA foam base 2600, 2602. The molded EVA foam bases 2600, 2602 can include toe caps 2604, 2606 and also can support wrapped fabric uppers 2608, 2610. The wrapped fabric uppers 2608, 2610 also can include elastic stretch zones 2612, in some embodiments. Other components of the hair straightener 100 can be formed from various materials including rigid, semi-rigid, semi-flexible, and/or flexible materials. It should be understood that the illustrated example is illustrative and therefore should not be construed as being limiting in any way.

According to various embodiments of the concepts and technologies described herein, the hair straightener 100 can have an operating temperature range of about one hundred degrees Fahrenheit to about two hundred thirty degrees Fahrenheit. In some embodiments, the operating temperature range can include a range of about one hundred twenty degrees Fahrenheit to about two hundred twenty degrees Fahrenheit. Other temperature ranges are possible, but in some embodiments, higher than about two hundred twenty may be avoided to avoid damaging or burning hair. In some other embodiments, higher temperatures may be used with the invention that the hair be exposed for short time periods to avoid burning or damaging the hair. It should be understood that these examples are illustrative and therefore should not be construed as being limiting in any way.

Figure 27:
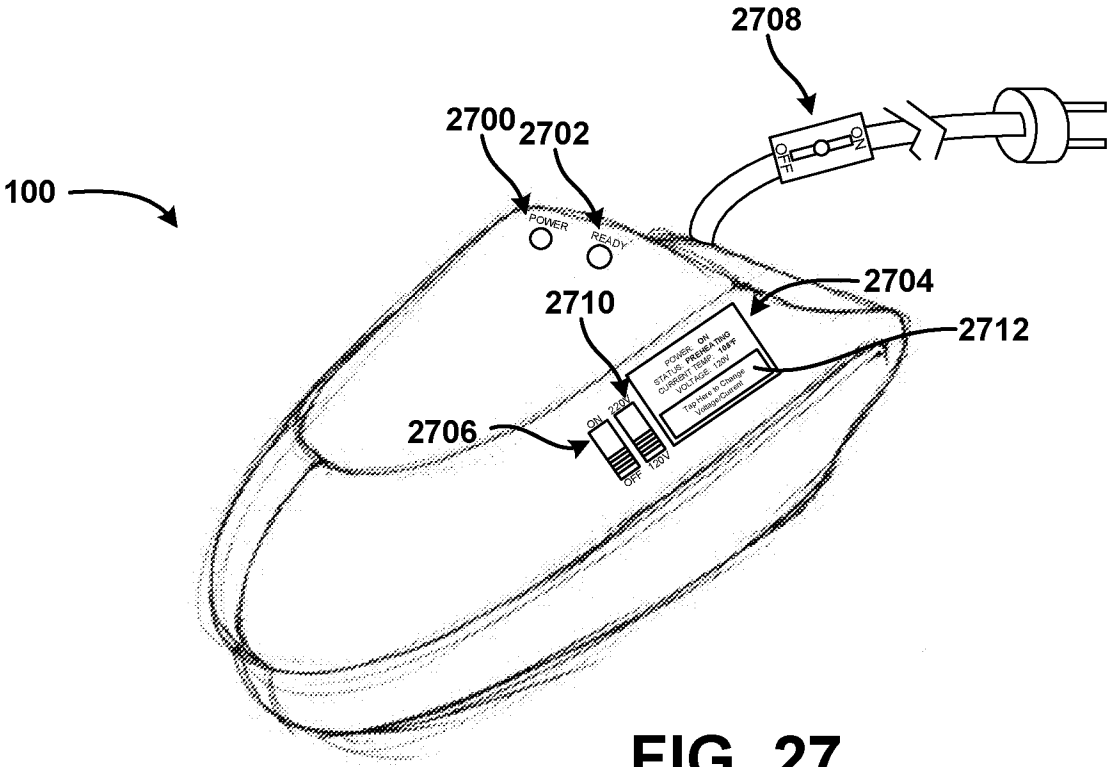
FIG. 27 is a line drawing illustrating some features of a hair straightener, according to an illustrative embodiment of the concepts and technologies described herein.

In some embodiments, the hair straightener 100 can include one or more indicators such as light emitting diodes ("LEDs"), sound emitters, or displays for indicating to a user that the hair straightener 100 has attained an operating temperature, that the hair straightener 100 has not yet attained the operating temperature, or the like. Thus, as shown in FIG. 27, the hair straightener 100 can include one or more indicators 2700, 2702 for indicating temperature information and/or a display 2704 for indicating temperature information. Because the temperature also can be indicated by beeps or other signals, it should be understood that these examples are illustrative and therefore should not be construed as being limiting in any way.

Similarly, as shown in FIG. 27, the hair straightener 100 can include an on/off switch 2706 for turning the hair straightener 100 and/or the heating elements thereof on or off. In some embodiments, as shown in FIG. 27, the on/off switch 2706 can be located on the hair straightener 100. In some other embodiments, the on/off switch can be located on a chord of the hair straightener 100, as shown at 2708. In yet other embodiments, the hair straightener 100 can be turned on or off by plugging the hair straightener 100 in or unplugging the hair straightener 100, respectively. Because other mechanisms for turning electrical devices on and/or off are possible and are contemplated, it should be understood that these examples are illustrative and therefore should not be construed as being limiting in any way.

Also, as shown in FIG. 27, the hair straightener 100 can include a switch or other mechanism for setting a current usage. Thus, a hardware switch and/or a menu option on a display can be used to set a current and/or voltage being used to power the hair straightener 100 to avoid damage, or for other purposes. In FIG. 27, a hardware switch 2710 is shown, and a menu option 2712 is also shown. It should be understood that one or both of these may be included, or that other functionality for setting current/voltage can be included with the hair straightener 100. Because other mechanisms for setting the current and/or voltage for the hair straightener 100 are possible and are contemplated, it should be understood that these examples are illustrative and therefore should not be construed as being limiting in any way.

Figure 28:
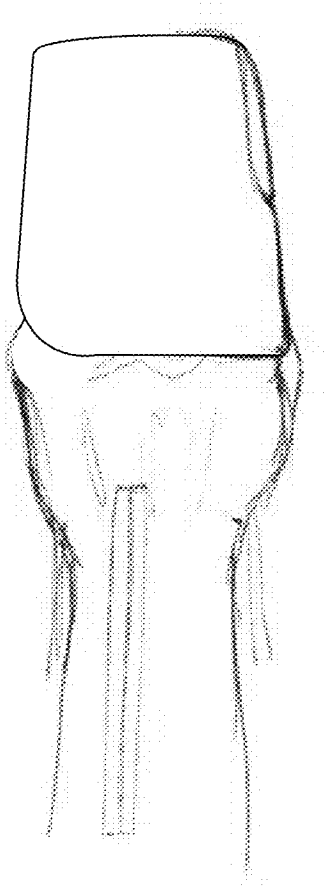
FIG. 28 is a line drawing illustrating a hair straightener, according to another illustrative embodiment of the concepts and technologies described herein.

FIG. 28 illustrates another embodiment of the hair straightener 100. As shown in FIG. 28, and as illustrated and described above, the hair straightener 100 can be configured to be held by more than two, three, or four fingers. In the illustrated embodiment, four of a user's fingers can be placed into the top portion 102 and the user's thumb can be placed into the bottom portion 104. It should be understood that this example is illustrative and therefore should not be construed as being limiting in any way.

Based on the foregoing, it should be appreciated that embodiments of a hair straightener have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A hair straightener comprising:

a top portion comprising a top heating plate, a padded liner, and a first hollow end, the top heating plate comprising a first heating element and the first hollow end comprising a first aperture formed in the top portion, wherein the first aperture is configured to receive a finger of a user;

a bottom portion comprising a bottom heating plate and a second hollow end, the bottom heating plate comprising a second heating element and the second hollow end comprising a second aperture formed in the bottom portion, wherein the second aperture is configured to receive a thumb of the user; and a hinge structure that joins the top portion to the bottom portion, wherein the padded liner is located within the top portion.

2. The hair straightener of claim 1, further comprising a spring mechanism.

3. The hair straightener of claim 2, wherein the spring mechanism is located between the top portion and the bottom portion.

4. The hair straightener of claim 1, wherein the hinge structure comprises a spring mechanism, and wherein the top portion, the bottom portion, and the spring mechanism are formed from a single piece of material.

5. The hair straightener of claim 1, wherein at least a portion of the top portion comprises rigid plastic.

6. The hair straightener of claim 1, wherein at least a portion of the top portion comprises soft silicone.

7. The hair straightener of claim 1, wherein at least a portion of the top portion comprises neoprene.

8. The hair straightener of claim 1, wherein the top heating plate comprises a sleeve and the first heating element.

9. The hair straightener of claim 8, wherein the first heating element comprises a substrate, a conductive coil, and electrical connectors.

10. The hair straightener of claim 9, wherein the conductive coil is electrically connected to a power source.

11. The hair straightener of claim 10, wherein the power source comprises a battery located within the hair straightener.

12. The hair straightener of claim 10, wherein the power source comprises an external power source, and wherein the conductive coil is electrically connected to the power source by way of a power cord.

13. The hair straightener of claim 1, further comprising a spring mechanism that is configured to apply a spring force to the top portion and the bottom portion to urge the top portion away from the bottom portion.

14. The hair straightener of claim 1, further comprising a spring mechanism that is configured to apply a spring force to the top portion and the bottom portion to urge the top portion toward the bottom portion.

15. A hair straightener comprising:

a top portion comprising a top heating plate and a first hollow end, the top heating plate comprising a sleeve and a first heating element and the first hollow end comprising a first opening formed in the top portion, wherein the first opening is configured to receive a finger of a user;

a bottom portion comprising a bottom heating plate and a second hollow end, the bottom heating plate comprising a second heating element and the second hollow end comprising a second opening formed in the bottom portion, wherein the second opening is configured to receive a thumb of the user; and a hinge structure that joins the top portion to the bottom portion, the hinge structure comprising a spring mechanism.

16. The hair straightener of claim 15, wherein the first heating element comprises a substrate, a conductive coil, and electrical connectors.

17. The hair straightener of claim 15, further comprising a padded liner located within the top portion.

18. A hair straightener comprising:

a top portion comprising a top heating plate and a first hollow end, the top heating plate comprising a sleeve and a first heating element, and the first hollow end comprising a first aperture formed in the top portion, wherein the first aperture is configured to receive a finger of a user;

a bottom portion comprising a bottom heating plate and a second hollow end, the bottom heating plate comprising a second heating element and the second hollow end comprising a second aperture formed in the bottom portion, wherein the second aperture is configured to receive a thumb of the user; and a hinge structure that joins the top portion to the bottom portion.

19. The hair straightener of claim 18, wherein the first heating element comprises a substrate, a conductive coil, and electrical connectors.

* * * * *